US010377016B2

(12) United States Patent
Ramanath et al.

(10) Patent No.: US 10,377,016 B2
(45) Date of Patent: Aug. 13, 2019

(54) BONDED ABRASIVE ARTICLE AND METHOD OF GRINDING

(71) Applicants: Saint-Gobain Abrasives, Inc., Worcester, MA (US); Saint-Gobain Abrasifs, Conflans-Sainte-Honorine (FR)

(72) Inventors: Srinivasan Ramanath, Holden, MA (US); Kenneth A. Saucier, Leicester, MA (US); Rachana Upadhyay, Shrewsbury, MA (US); Lenny C. Sales, Carol Stream, IL (US); Marc A. Lamoureux, Leicester, MA (US); Matthew F. Jacob, Jefferson, MA (US); Cong Wang, Evanston, IL (US)

(73) Assignees: SAINT-GOBAIN ABRASIVES, INC., Worcester, MA (US); SAINT-GOBAIN ABRASIFS, Conflans-Sainte-Honorine (FR)

( * ) Notice: Subject to any disclaimer, the term of this patent is extended or adjusted under 35 U.S.C. 154(b) by 1042 days.

(21) Appl. No.: 14/819,670

(22) Filed: Aug. 6, 2015

(65) Prior Publication Data

US 2015/0336240 A1 Nov. 26, 2015

Related U.S. Application Data

(63) Continuation of application No. 14/143,306, filed on Dec. 30, 2013, now Pat. No. 9,102,039.

(Continued)

(51) Int. Cl.
*B24D 3/00* (2006.01)
*B24D 3/06* (2006.01)

(52) U.S. Cl.
CPC ..... *B24D 3/06* (2013.01); *B24D 3/008* (2013.01)

(58) Field of Classification Search
CPC ..... B24D 3/00; B24D 3/06; B24D 3/008
See application file for complete search history.

(56) References Cited

U.S. PATENT DOCUMENTS 2,811,430 A 10/1957 Gregor et al.
2,892,811 A 6/1959 Irany
(Continued)

FOREIGN PATENT DOCUMENTS

CN 101450463 A 6/2009
CN 101896316 A 11/2010
(Continued)

OTHER PUBLICATIONS

Extended European Search Report for EP Application No. EP11822738.8, dated Jun. 21, 2016, 8 pages.
(Continued)

*Primary Examiner* — Pegah Parvini
(74) *Attorney, Agent, or Firm* — Abel Schillinger, LLP; Joseph P. Sullivan

(57) ABSTRACT

An abrasive article comprising: a first body comprising a first bond material having abrasive particles contained within the first bond material, wherein the first body comprising the first bond material comprises a ratio of $V_{AG(1)}/V_{BM(1)}$ of at least about 1.3; a second body comprising a second bond material having abrasive particles contained within the second bond material, wherein the second body comprising the second bond material comprises a ratio of $V_{AG(2)}/V_{BM(2)}$ of less than about 1.3, and wherein $V_{AG}$ is a volume percent of abrasive particles within a total volume of the first or second body respectively and $V_{BM}$ is a volume percent of the first or second bond material within the total volume of the first or second body respectively.

18 Claims, 4 Drawing Sheets

Related U.S. Application Data

(60) Provisional application No. 61/748,006, filed on Dec. 31, 2012.

(56) References Cited

U.S. PATENT DOCUMENTS

| | | | |
|---|---|---|---|
| 2,939,777 | A | 6/1960 | Gregor et al. |
| 2,940,841 | A | 6/1960 | Gregor et al. |
| 3,203,775 | A | 8/1965 | Cantrell |
| 3,510,994 | A | 5/1970 | Amero et al. |
| 3,535,832 | A | 10/1970 | Amero |
| 3,547,609 | A | 12/1970 | Gerry |
| 3,594,141 | A | 7/1971 | Houston et al. |
| 3,650,715 | A | 3/1972 | Brushek et al. |
| 3,664,819 | A | 5/1972 | Sioui et al. |
| 4,010,583 | A | 3/1977 | Highberg |
| 4,024,675 | A | 5/1977 | Naidich et al. |
| 4,042,347 | A | 8/1977 | Sioui |
| 4,063,909 | A | 12/1977 | Mitchell |
| 4,399,167 | A | 8/1983 | Pipkin |
| 4,541,205 | A | 9/1985 | Patrello |
| 4,802,895 | A | 2/1989 | Burnand et al. |
| 4,923,490 | A | 5/1990 | Johnson et al. |
| 5,011,514 | A | 4/1991 | Cho et al. |
| 5,035,723 | A | 7/1991 | Kalinowski et al. |
| 5,048,235 | A | 9/1991 | Smith |
| 5,173,091 | A | 12/1992 | Marek |
| 5,221,294 | A | 6/1993 | Carman et al. |
| 5,385,591 | A | 1/1995 | Ramanath et al. |
| 5,429,648 | A | 7/1995 | Wu |
| 5,556,438 | A | 9/1996 | Kardys et al. |
| 5,637,123 | A | 6/1997 | Ishizaki et al. |
| 5,658,194 | A | 8/1997 | Micheletti |
| 5,738,696 | A | 4/1998 | Wu |
| 5,785,784 | A | 7/1998 | Chesley et al. |
| 5,912,217 | A | 6/1999 | Sumiya et al. |
| 5,932,508 | A | 8/1999 | Armstrong et al. |
| 6,012,977 | A | 1/2000 | Yoshikawa et al. |
| 6,019,668 | A | 2/2000 | Ramanath et al. |
| 6,056,795 | A | 5/2000 | Ramanath et al. |
| 6,063,148 | A | 5/2000 | Fishbacher |
| 6,093,092 | A | 7/2000 | Ramanath et al. |
| 6,102,789 | A | 8/2000 | Ramanath et al. |
| 6,200,208 | B1 | 3/2001 | Andrews et al. |
| 6,220,933 | B1 | 4/2001 | Shih et al. |
| 6,485,532 | B2 | 11/2002 | Andrews et al. |
| 6,485,533 | B1 | 11/2002 | Ishizaki et al. |
| 6,679,758 | B2 | 1/2004 | Bright et al. |
| 6,685,755 | B2 | 2/2004 | Ramanath et al. |
| 6,754,827 | B1 | 6/2004 | Cane et al. |
| 6,755,729 | B2 | 6/2004 | Ramanath et al. |
| 6,988,937 | B2 | 1/2006 | Bonner et al. |
| 7,007,382 | B2 | 3/2006 | Mantel |
| 7,033,408 | B2 | 4/2006 | Fries et al. |
| 7,074,247 | B2 | 7/2006 | Tank et al. |
| 7,077,723 | B2 | 7/2006 | Bright et al. |
| 7,144,307 | B2 | 12/2006 | Schwartz et al. |
| 7,275,980 | B2 | 10/2007 | Bonner et al. |
| 7,285,146 | B2 | 10/2007 | Petersen |
| 7,303,461 | B1 | 12/2007 | Campomanes et al. |
| 7,628,829 | B2 | 12/2009 | Woo et al. |
| 7,708,619 | B2 | 5/2010 | Subramanian et al. |
| 7,833,086 | B2 | 11/2010 | Mielke |
| 7,896,728 | B2 | 3/2011 | Schwartz et al. |
| 7,971,356 | B2 | 7/2011 | Orobengoa Ortubay et al. |
| 8,377,158 | B2 | 2/2013 | Palmgren et al. |
| 8,715,381 | B2 | 5/2014 | Ramanath et al. |
| 9,102,039 | B2 * | 8/2015 | Ramanath ..... B24D 3/008 |
| 9,254,553 | B2 | 2/2016 | Ramanath et al. |
| 9,833,877 | B2 | 12/2017 | Ramanath et al. |
| 2001/0027623 | A1 | 10/2001 | Rosenflanz |
| 2002/0006768 | A1 | 1/2002 | Wada et al. |
| 2002/0016139 | A1 | 2/2002 | Hirokawa et al. |
| 2002/0066233 | A1 | 6/2002 | McArdle et al. |
| 2002/0095871 | A1 | 7/2002 | McArdle et al. |
| 2003/0097800 | A1 | 5/2003 | Ramanath et al. |
| 2003/0178138 | A1 | 9/2003 | Tsukagoshi et al. |
| 2003/0194947 | A1 | 10/2003 | Bright et al. |
| 2003/0232586 | A1 | 12/2003 | Ramanath et al. |
| 2005/0026553 | A1 | 2/2005 | Bonner et al. |
| 2005/0101225 | A1 | 5/2005 | Bright et al. |
| 2005/0129975 | A1 | 6/2005 | Ihara |
| 2005/0257430 | A1 | 11/2005 | Fries et al. |
| 2005/0260939 | A1 | 11/2005 | Andrews et al. |
| 2007/0074456 | A1 | 4/2007 | Orlhac et al. |
| 2007/0275641 | A1 | 11/2007 | Subramanian et al. |
| 2008/0085660 | A1 | 4/2008 | Orlhac |
| 2008/0131216 | A1 | 6/2008 | Sasu et al. |
| 2009/0084042 | A1 | 4/2009 | Ramanath et al. |
| 2009/0093198 | A1 | 4/2009 | Subramanian et al. |
| 2009/0094831 | A1 | 4/2009 | Schwartz et al. |
| 2009/0104854 | A1 | 4/2009 | Junker |
| 2009/0151267 | A1 | 6/2009 | Upadhyay et al. |
| 2009/0156104 | A1 | 6/2009 | Kim et al. |
| 2010/0000158 | A1 | 1/2010 | De Leeuw-Morrison et al. |
| 2010/0000159 | A1 | 1/2010 | Walia et al. |
| 2010/0159806 | A1 | 6/2010 | Wu et al. |
| 2010/0162632 | A1 | 7/2010 | Zuyev et al. |
| 2010/0190424 | A1 | 7/2010 | Francois et al. |
| 2010/0196700 | A1 | 8/2010 | Orlhac et al. |
| 2010/0319269 | A1 | 12/2010 | Erickson |
| 2011/0143641 | A1 * | 6/2011 | Ramanath ..... B24D 7/06 451/548 |
| 2011/0179646 | A1 | 7/2011 | Barnat |
| 2011/0284841 | A1 | 11/2011 | Kondou |
| 2011/0306276 | A1 | 12/2011 | Gagliardi |
| 2012/0040589 | A1 | 2/2012 | Upadhyay et al. |
| 2012/0055098 | A1 | 3/2012 | Ramanath et al. |
| 2012/0066982 | A1 | 3/2012 | Ramanath et al. |
| 2012/0192499 | A1 | 8/2012 | Sung |
| 2013/0000211 | A1 | 1/2013 | Upadhyay et al. |
| 2013/0174494 | A1 | 7/2013 | Raoul et al. |
| 2013/0219800 | A1 | 8/2013 | Guiselin |
| 2014/0057534 | A1 | 2/2014 | Hajduk et al. |
| 2014/0187123 | A1 | 7/2014 | Ramanath et al. |
| 2014/0187124 | A1 | 7/2014 | Ramanath et al. |
| 2014/0187125 | A1 | 7/2014 | Ramanath et al. |
| 2014/0298729 | A1 | 10/2014 | Ramanath et al. |

FOREIGN PATENT DOCUMENTS

| | | | |
|---|---|---|---|
| EP | 174546 | A2 | 8/1985 |
| EP | 0198653 | A1 | 10/1986 |
| EP | 0945221 | A2 | 9/1999 |
| EP | 1144160 | B1 | 10/2001 |
| GB | 485565 | A | 5/1938 |
| GB | 516475 | A | 1/1940 |
| GB | 1148596 | A | 4/1969 |
| GB | 1598837 | A | 9/1981 |
| JP | 51140289 | A | 12/1976 |
| JP | S59-035066 | A | 2/1984 |
| JP | 59182064 | A | 10/1984 |
| JP | S61-270074 | A | 11/1986 |
| JP | S61-270285 | A | 11/1986 |
| JP | S61-293769 | A | 12/1986 |
| JP | S62-28176 | A | 2/1987 |
| JP | S62-057871 | A | 3/1987 |
| JP | 63256364 | A | 10/1988 |
| JP | H02-015977 | A | 1/1990 |
| JP | 2088176 | A | 3/1990 |
| JP | 3161273 | A | 7/1991 |
| JP | 3190670 | A | 8/1991 |
| JP | 3264263 | A | 11/1991 |
| JP | 3281174 | A | 12/1991 |
| JP | H06-344264 | A | 12/1994 |
| JP | H07-1339 | A | 1/1995 |
| JP | 07-211723 | A | 8/1995 |
| JP | H08-133839 | A | 5/1996 |
| JP | H08-206962 | A | 8/1996 |
| JP | 10094967 | A | 4/1998 |
| JP | 11-320354 | A | 11/1999 |
| JP | 2000-317843 | A | 11/2000 |
| JP | 2000-326236 | A | 11/2000 |
| JP | 2000-516156 | A | 12/2000 |
| JP | 2001-062601 | A | 3/2001 |

(56) References Cited

FOREIGN PATENT DOCUMENTS

| | | | |
|---|---|---|---|
| JP | 2001-246560 | A | 9/2001 |
| JP | 2002-273661 | A | 9/2002 |
| JP | 2002-534281 | A | 10/2002 |
| JP | 2002-370172 | A | 12/2002 |
| JP | 2003-181765 | A | 7/2003 |
| JP | 2004-291218 | A | 10/2004 |
| JP | 2005-342836 | A | 12/2005 |
| JP | 2006-082187 | A | 3/2006 |
| JP | 2006-346824 | A | 12/2006 |
| SU | 1227441 | A1 | 4/1986 |
| WO | 98/24593 | A1 | 6/1998 |
| WO | 03/045634 | A1 | 6/2003 |
| WO | 03/086704 | A1 | 10/2003 |
| WO | 2006/008258 | A1 | 1/2006 |
| WO | 2012/031229 | A2 | 3/2012 |
| WO | 2012031251 | A2 | 3/2012 |
| WO | 2014/106156 | A1 | 7/2014 |
| WO | 2014/106157 | A1 | 7/2014 |
| WO | 2014/106159 | A1 | 7/2014 |
| WO | 2014/165447 | A1 | 10/2014 |

OTHER PUBLICATIONS

Extended European Search Report for EP Application No. EP13869142.3, dated Aug. 4, 2016, 10 pages.

Extended European Search Report for EP Application No. EP13868550.8, dated Aug. 29, 2016, 9 pages.

International Search Report from PCT/US2013/078225 dated May 1, 2014, 1 page.

International Search Report from PCT/US2013/078227 dated Apr. 23, 2014, 1 page.

International Search Report from PCT/US2013/078231 dated Apr. 24, 2014, 1 page.

International Search Report from PCT/US2014/032384 dated Jul. 15, 2014, 1 page.

PCT/US2011/050412 ISR WO, dated Apr. 10, 2012.

PCT/US2011/050384 ISR WO, dated Apr. 10, 2012.

Dai et al, "Experimental Study on Porous Metal Bonded Diamond Grinding Wheels (III)—Grinding Performance of Porous Wheels", Key Engineering Materials, 359-60, 48-52, 2008.

Matsumaru et al, "Fabrication of Porous Metal Bonded Diamond Grinding Wheels for Flat-Surface Nonomachining", MRS Bulletin, 26, 7, 544-6, 2001.

Truong et al, "Study on the Toughening of Bond Bridge of Ni—Cu'Sn Alloy—Development of Porous Meta Bonded Diamond Wheel", Seimitsu Kogaku Kaishi/Journal of the Japan Society for Precision Engineering, 0912-0289, 1998.

Tanaka, "Development of the Bridged and Pored Type of Metal Bond Diamond Wheel", Seimitsu Kogaku Kaishi/Journal of the Japan Society for Precision Engineering, 0912-0289, 1991.

Dai et al, "Effects of Alloying Additives on the Grinding Performance of Porous Wheels", Journal of Fuzhou University (Natural Science Edition), 37, 1, 80-85, 2009.

Truong et al, "Scanning Electron Microscopic Study and Mechanical Property Examination of a Bond Bridge: Development of a Porous Metal Bonded Diamond Wheel", Journal of Materials Processing Technology (Netherlands), 89-90, 385-391, 1999.

* cited by examiner

BONDED ABRASIVE ARTICLE AND METHOD OF GRINDING

CROSS-REFERENCE TO RELATED APPLICATION(S)

The present application is a continuation of and claims priority from U.S. patent application Ser. No. 14/143,306 filed Dec. 30, 2013, which claims priority under 35 U.S.C. § 119(e) to U.S. Patent Application No. 61/748,006 entitled "Bonded Abrasive Article and Method of Grinding," by Inventors Srinivasan Ramanath, Kenneth A. Saucier, Rachana Upadhyay, Lenny C. Sales, Marc A. Lamoureux, Matthew F. Jacob and Cong Wang, filed Dec. 31, 2012, which is assigned to the current assignee hereof and incorporated herein by reference in its entirety.

BACKGROUND

Field of the Disclosure

The following is directed bonded abrasive articles, and more particularly, bonded abrasive articles including abrasive particles contained within two distinct abrasive bodies.

Description of the Related Art

Abrasives used in machining applications typically include bonded abrasive articles and coated abrasive articles. Coated abrasive articles are generally layered articles having a backing and an adhesive coat to fix abrasive particles to the backing, the most common example of which is sandpaper. Bonded abrasive tools consist of rigid, and typically monolithic, three-dimensional, abrasive composites in the form of wheels, discs, segments, mounted points, hones and other tool shapes, which can be mounted onto a machining apparatus, such as a grinding or polishing apparatus.

Bonded abrasive tools usually have at least two phases including abrasive particles and bond material. Certain bonded abrasive articles can have an additional phase in the form of porosity. Bonded abrasive tools can be manufactured in a variety of 'grades' and 'structures' that have been defined according to practice in the art by the relative hardness and density of the abrasive composite (grade) and by the volume percentage of abrasive grain, bond, and porosity within the composite (structure).

Some bonded abrasive tools may be particularly useful in grinding and shaping certain types of workpieces, including for example, metals, ceramics and crystalline materials, used in the electronics and optics industries. In other instances, certain bonded abrasive tools may be used in shaping of superabrasive materials for use in industrial applications. In the context of grinding and shaping certain workpieces with metal-bonded abrasive articles, generally the process involves a significant amount of time and labor directed to maintaining the bonded abrasive article. That is, generally, metal-bonded abrasive articles require regular truing and dressing operations to maintain the grinding capabilities of the abrasive article.

The industry continues to demand improved methods and articles capable of grinding.

SUMMARY

A first aspect of the disclosure includes an abrasive article comprising: a first body comprising a first bond material having abrasive particles contained within the first bond material, wherein the first body comprising the first bond material comprises a ratio of $V_{AG(1)}/V_{BM(1)}$ of at least about 1.3; a second body comprising a second bond material having abrasive particles contained within the second bond material, wherein the second body comprising the second bond material comprises a ratio of $V_{AG(2)}/V_{BM(2)}$ of less than about 1.3, and wherein $V_{AG}$ is a volume percent of abrasive particles within a total volume of the first or second body respectively and $V_{BM}$ is a volume percent of the first or second bond material within the total volume of the first or second body respectively.

Another aspect of the disclosure includes an abrasive article comprising: a first body comprising a first bond material having abrasive particles contained within the first bond material, a second body comprising a second bond material having abrasive particles contained within the second bond material, wherein the first bond material and the second bond material are different, and wherein the first body is adjacent to but spaced apart from the second body.

Yet another aspect of the disclosure includes an abrasive article comprising: a first body comprising a first bond material having abrasive particles contained within the first bond material, a second body comprising a second bond material having abrasive particles contained within the second bond material, wherein the first bond material is different than the second bond material, wherein, after a periphery insert grinding test operation on at least an edge of a workpiece, the edge of the workpiece has a maximum chip size of less than about 0.0025 inches.

Yet still another aspect of the disclosure includes a method of removing material from a workpiece comprising: providing a workpiece; and removing material from at least an edge of the workpiece with an abrasive article, wherein the abrasive article comprises: a first body comprising a first bond material having abrasive particles contained within the first bond material, wherein the first body comprising the first bond material comprises a ratio of $V_{AG(1)}/V_{BM(1)}$ of at least about 1.3; a second body comprising a second bond material having abrasive particles contained within the second bond material, wherein the second body comprising the second bond material comprises a ratio of $V_{AG(2)}/V_{BM(2)}$ of less than about 1.3, and wherein $V_{AG}$ is a volume percent of abrasive particles within a total volume of the first or second body respectively and $V_{BM}$ is a volume percent of the first or second bond material within the total volume of the first or second body respectively.

Yet another embodiment includes a method of removing material from a plurality of workpieces comprising: providing a plurality of workpieces; and performing consecutive periphery grinding operations on at least 5 workpieces with an abrasive article comprising a first body and a second body spaced apart from the first body, wherein the consecutive periphery grinding operations are performed without dressing the abrasive article in between the consecutive periphery grinding operations; wherein, after performing the periphery grinding operations, the plurality of workpieces have an average maximum chip size on the edge of the workpiece of less than about 0.0025 inches.

BRIEF DESCRIPTION OF THE DRAWINGS

The present disclosure may be better understood, and its numerous features and advantages made apparent to those skilled in the art by referencing the accompanying drawings.

The use of the same reference symbols in different drawings indicates similar or identical items.

DETAILED DESCRIPTION

Figure 1A:
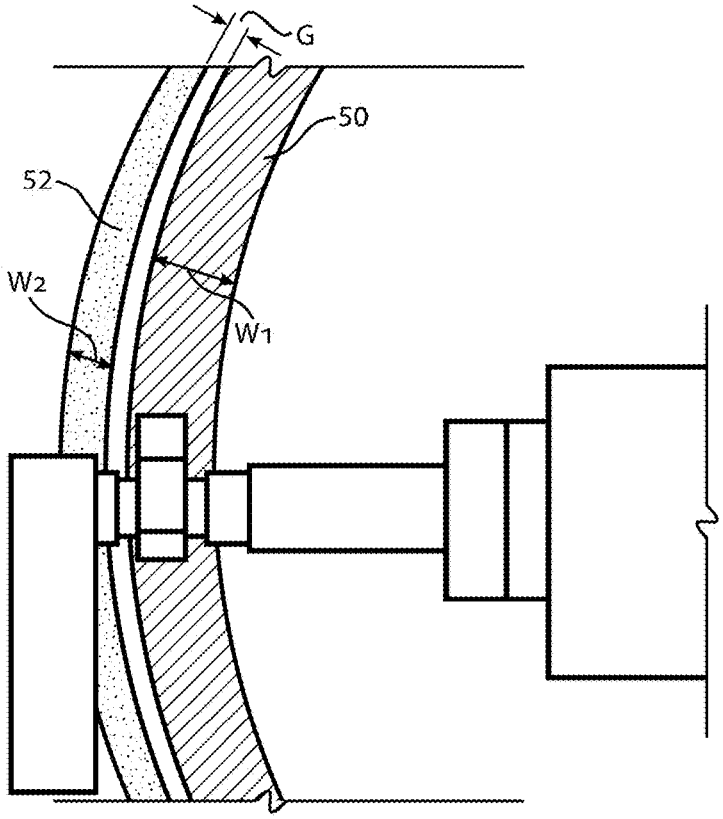
FIG. 1A includes an illustration of a periphery grinding operation.

The following is generally directed to bonded abrasive articles incorporating at least two abrasive bodies, each having abrasive particles within a three-dimensional matrix of material. Bonded abrasive articles utilize a volume of abrasive particles secured within a three-dimensional matrix of bond material. Moreover, the following includes description related to methods of forming such bonded abrasive articles and applications for such bonded abrasive articles.

In accordance with an embodiment, the process for forming an abrasive article can be initiated by forming a first mixture and a second mixture containing abrasive particles and bond material. The first mixture can contain a different bond material than the second mixture.

In accordance with an embodiment, the abrasive particles can include a hard material. For example, the abrasive particles can have a Mohs hardness of at least about 7. In other abrasive bodies, the abrasive particles can have a Mohs hardness of at least 8, or even at least 9.

In particular instances, the abrasive particles can be made of an inorganic material. Suitable inorganic materials can include carbides, oxides, nitrides, borides, oxycarbides, oxyborides, oxynitrides, and a combination thereof. Particular, examples of abrasive particles include silicon carbide, boron carbide, alumina, zirconia, alumina-zirconia composite particles, silicon nitride, SiAlON, and titanium boride. In certain instances, the abrasive particles can include a superabrasive material, such as diamond, cubic boron nitride, and a combination thereof. In particular instances, the abrasive particles can consist essentially of diamond.

The abrasive particles contained within the first or second bond material can have an average particle size of not greater than about 45 microns, not greater than about 44 microns, not greater than about 40 microns, not greater than about 38 microns, not greater than about 36 microns, not greater than about 34 microns, no greater than about 32 microns, not greater than about 30 microns, not greater than about 28 microns, not greater than about 26 microns, not greater than about 24 microns, not greater than about 22 microns, or even not greater than about 20 microns. In other embodiments, the abrasive particles can have an average particle size of at least about 1 micron, at least about 2 microns, at least about 4 microns, at least about 6 microns, at least about 8 microns, at least about 10 microns, at least about 12 microns, at least about 14 microns, at least about 16 microns, at least about 18 microns, or even at least about 20 microns. In particular instances, the abrasive particles of embodiments herein can have an average particle size, within a range between any of the average particle sizes described above. For example, the abrasive particles of embodiments herein can have an average particle size, within a range between about 1 micron to about 45 microns or even between about 10 to about 20 microns.

In further reference to the abrasive particles, the morphology of the abrasive particles can be described by an aspect ratio, which is a ratio between the dimensions of length to width. It will be appreciated that the length is the longest dimension of the abrasive particle and the width is the second longest dimension of a given abrasive particle. In accordance with embodiments herein, the abrasive particles can have an aspect ratio (length:width) of not greater than about 2:1 or even not greater than about 1.5:1. In particular instances, the abrasive particles can be essentially equi-axed, such that they have an aspect ratio of approximately 1:1.

The abrasive particles can include other features, including for example, a coating. The abrasive particles can be coated with a coating material which may be an inorganic material. Suitable inorganic materials can include a ceramic, a glass, a metal, a metal alloy, and a combination thereof. In particular instances, the abrasive particles can be electroplated with a metal material and, more particularly, a transition metal composition. Such coated abrasive particles may facilitate improved bonding (e.g., chemical bonding) between the abrasive particles and the bond material.

It will also be appreciated that abrasive particles of the same composition can have various mechanical properties, including for example, friability. The mixture, and the final-formed bonded abrasive body, can incorporate a mixture of abrasive particles, which may be the same composition, but having varying mechanical properties or grades. For example, the mixture can include abrasive particles of a single composition, such that the mixture includes only diamond or cubic boron nitride. However, the diamond or cubic boron nitride can include a mixture of different grades of diamond or cubic boron nitride, such that the abrasive particles having varying grades and varying mechanical properties.

The abrasive particle type, size, and any other characteristics described herein in the first and second body can be the same or different. In particular embodiments, the abrasive particles have essentially the same particle size in the first and second bodies.

The abrasive particles can be provided in the first or second mixture in an amount such that the finally-formed abrasive article contains a particular amount of abrasive particles. For example, the mixture can include a majority content (e.g., greater than 50 vol %) of abrasive particles.

In accordance with an embodiment, the bond material in the first mixture can be a metal or metal alloy material. For example, the bond material can include a powder composition including at least one transition metal element. In particular instances, the bond material can include a metal selected from the group including copper, tin, silver, molybdenum, zinc, tungsten, iron, nickel, antimony, and a combination thereof. In one particular embodiment, the bond material can be a metal alloy including copper and tin. The metal alloy of copper and tin can be a bronze material, which may be formed of a 60:40 by weight composition of copper and tin, respectively.

According to a particular embodiment, the metal alloy of copper and tin can include a certain content of copper, such that the final-formed bonded abrasive article has suitable mechanical characteristics and grinding performance. For example, the copper and tin metal alloy can include not greater than about 70% copper, such as not greater than about 65% copper, not greater than about 60% not greater than about 50% copper, not greater than about 45% copper, or even not greater than about 40% copper. In particular instances, the amount of copper is within a range between about 30% and about 65%, and more particularly, between about 40% and about 65%.

Certain metal alloys of copper and tin can have a minimum amount of tin. For example, the metal alloy can include at least about 30% tin of the total amount of the composition. In other instances, the amount of tin can be greater, such as at least about 35%, at least about 40%, at least about 45%, at least about 50%, at least about 60%, at least about 65%, or even at least about 75%. Certain bond materials can include a copper and tin metal alloy having an amount of tin within a range between about 30% and about 80%, between about 30% and about 70%, or even between about 35% and about 65%.

In an alternative embodiment, the bond material in the first mixture can be a tin-based material, wherein tin-based materials include metal and metal alloys comprising a majority content of tin versus other compounds present in the material. For example, the bond material can consist essentially of tin. Still, certain-tin-based bond materials may be used that include not greater than about 10% of other alloying materials, particularly metals.

In accordance with an embodiment, the bond material in the second mixture can contain an organic material. In certain embodiments, the second bond material can include phenol formaldehydes, novalacs, melamines, acrylics, polyimides, polyamides, aramids, epoxies, polyesters, polyurethanes, acetates, or a combination thereof.

In certain embodiments, the first or second mixture can be formed such that the amount of bond material can be less than the amount of abrasive particles within the mixture. Such a mixture facilitates a bonded abrasive article having certain properties, which are described in more detail herein.

In addition to the abrasive particles and bond material, the first or second mixture can further include an active bond composition precursor. The active bond composition precursor includes a material, which can be added to the mixture that later facilitates a chemical reaction between certain components of the bonded abrasive body, including for example, particulate material (e.g., abrasive particles and/or fillers) and bond material. The active bond composition precursor can be added to the mixture in minor amounts, and particularly, in amounts less than the amount of the abrasive particles present within the mixture.

In accordance with an embodiment, the active bond composition precursor can include a composition including a metal or metal alloy. More particularly, the active bond composition precursor can include a composition or complex including hydrogen. For example, the active bond composition precursor can include a metal hydride, and more particularly, can include a material such as titanium hydride. In one embodiment, the active bond composition precursor consists essentially of titanium hydride.

The first or second mixture generally includes a minor amount of the active bond composition precursor. For example, the first or second mixture can include not greater than about 40 wt % of the active bond composition precursor of the total weight of the mixture. In other embodiments, the amount of the active bond composition precursor within the mixture can be less, such as not greater than about 35 wt %, not greater than about 30 wt %, not greater than about 28 wt %, not greater than about 26 wt %, not greater than about 23 wt %, not greater than about 18 wt %, not greater than about 15 wt %, not greater than about 12 wt %, or even not greater than about 10 wt %. In particular instances, the amount of active bond composition precursor within the mixture can be within a range between about 2 wt % and about 40 wt %, such as between about 4 wt % and about 35 wt %, between about 8 wt % and about 28 wt %, between about 10 wt % and about 28 wt %, or even between about 12 wt %, and about 26 wt %. The first or second mixture can contain the same or different amount or type of active bond composition precursor. In particular embodiments, the second mixture does not contain an active bond composition precursor.

The first or second mixture can further include a binder material. The binder material may be utilized to provide suitable strength during formation of the bonded abrasive article. Certain suitable binder materials can include an organic material. For example, the organic material can be a material such as a thermoset, thermoplastic, adhesive and a combination thereof. In one particular instance, the organic material of the binder material includes a material such as polyimides, polyamides, resins, aramids, epoxies, polyesters, polyurethanes, acetates, celluloses, and a combination thereof. In one embodiment, the mixture can include a binder material utilizing a combination of a thermoplastic material configured to cure at a particular temperature. In another embodiment, the binder material can include an adhesive material suitable for facilitating attachment between components of the mixture. The binder can be in the form of a liquid, including for example, an aqueous-based or non-aqueous-based compound.

Generally, the binder material can be present in a minor amount (by weight) within the first or second mixture. For example, the binder can be present in amount significantly less than the amount of the abrasive particles, bond material, or the active bond composition precursor. For example, the mixture can include not greater than about 40 wt % of binder material for the total weight of the mixture. In other embodiments, the amount of binder material within the mixture can be less, such as not greater than about 35 wt %, not greater than about 30 wt %, not greater than about 28 wt %, not greater than about 26 wt %, not greater than about 23 wt %, not greater than about 18 wt %, not greater than about 15 wt %, not greater than about 12 wt %, or even not greater than about 10 wt %. In particular instances, the amount of binder material within the mixture can be within a range between about 2 wt % and about 40 wt %, such as between about 4 wt % and about 35 wt %, between about 8 wt % and about 28 wt %, between about 10 wt % and about 28 wt %, or even between about 12 wt % and about 26 wt %.

The first or second mixture can further include a certain amount of fillers. The fillers can be a particulate material, which may be substituted for certain components within the mixture, including for example, the abrasive particles. Notably, the fillers can be a particulate material that may be incorporated in the mixture, wherein the fillers substantially maintain their original size and shape in the finally-formed bonded abrasive body. Examples of suitable fillers can include oxides, carbides, borides, silicides, nitrides, oxynitrides, oxycarbides, silicates, graphite, silicon, inter-metallics, ceramics, hollow-ceramics, fused silica, glass, glass-ceramics, hollow glass spheres, natural materials such as shells, and a combination thereof.

Notably, certain fillers can have a hardness that is less than the hardness of the abrasive particles. Additionally, the mixture can be formed such that the fillers are present in an amount of not greater than about 90 vol % of the total volume of the mixture. Volume percent is used to describe the content of fillers as fillers can have varying density depending upon the type of particulate, such as hollow spheres versus heavy particulate. In other embodiments, the amount of filler within the mixture can be not greater than about 80 vol %, such as not greater than about 70 vol %, not greater than about 60 vol %, not greater than about 50 vol %, not greater than about 40 vol %, not greater than about 30 vol %, or even not greater than about 20 vol %.

Certain forming processes may utilize a greater amount of filler material than the amount of abrasive particles. For example, nearly all of the abrasive particles can be substituted with one or more filler materials. In other instances, a majority content of the abrasive particles can be substituted with filler material. In other embodiments, a minor portion of the abrasive particles can be substituted with filler material.

Moreover, the fillers can have an average particulate size that is significantly less than the average particle size of the abrasive particles. For example, the average particulate size of the fillers can be at least about 5% less, such as at least about 10% less, such as at least about 15% less, at least about 20% less, or even at least about 25% less than the average particle size of the abrasive particles based on the average particle size of the average particle size of the abrasive particles.

In certain other embodiments, the fillers can have an average particulate size that is greater than the abrasive particles, particularly in the context of fillers that are hollow bodies.

In particular instances, the filler material can have a fracture toughness ($K_{1c}$) of not greater than about 10 MPa $m^{0.5}$, as measured by a nano-indentation test via standardized test of ISO 14577 utilizing a diamond probe available from CSM Indentation Testers, Inc., Switzerland or similar companies. In other embodiments, the filler can have a fracture toughness ($K_{1c}$) of not greater than about 9 MPa $m^{0.5}$, such as not greater than about 8 MPa $m^{0.5}$, or even not greater than about 7 MPa $m^{0.5}$. Still, the average fracture toughness of the fillers can be within a range between about 0.5 MPa $m^{0.5}$ and about 10 MPa $m^{0.5}$, such as within a range between about 1 MPa $m^{0.5}$ and about 9 MPa $m^{0.5}$, or even within a range between about 1 MPa $m^{0.5}$ and about 7 MPa $m^{0.5}$.

The first and second mixture can contain the same or different filler material type, size, or amount.

After forming the first or second mixture, the process of forming the bonded abrasive article continues by shearing the mixture such that it has proper rheological characteristics. For example, the mixture can be sheared until it has a particular viscosity, and can have a consistency that is semi-liquid (e.g., a mud-like consistency). In other instances, it could be of much lower viscosity such as a paste. The first and second mixture can be sheared the same or different.

After shearing the first or second mixture, the process can continue by forming agglomerates from the first or second mixture. Process of forming agglomerates can initially include a process of drying the first or second mixture. In particular the drying process may be conducted at a temperature suitable to cure an organic component (e.g., thermoset) within the binder contained within the mixture, and remove a portion of certain volatiles (e.g., moisture) within the mixture. Thus, upon suitable curing the organic material within the binder material, the mixture can have a hardened or semi-hardened form. Particularly suitable drying temperatures can be not greater than about 100° C., and more particularly, within a range between about 0° C. and about 100° C. The drying process for the first and second mixtures can be the same or different.

After drying the first and second mixtures at a suitable temperature, the process of forming agglomerates can continue by crushing the hardened form. After crushing the hardened form, the crushed particles include agglomerates of the components contained within the mixture, including the abrasive particles and bond material. The process of forming the agglomerates can then include sieving of the crushed particulate to obtain a suitable distribution of agglomerate sizes.

After forming the agglomerates, the process can continue by shaping the agglomerates into a desirable shape of the finally-formed bonded abrasive article. One suitable shaping process includes filling a mold with the agglomerated particles. After filling the mold, the agglomerates can be pressed to form a green (i.e., unsintered) body having the dimensions of the mold. In accordance with one embodiment, pressing can be conducted at a pressure of at least about 0.01 ton/$in^2$ of the area of the bonded abrasive article. In other embodiments, the pressure can be greater, such as on the order of at least about 0.1 tons/$in^2$, at least about 0.5 tons/$in^2$, at least about 1 ton/$in^2$, or even at least about 2 tons/$in^2$. In one particular embodiment pressing is completed at a pressure within a range between about 0.01 ton/$in^2$ and about 10 tons/$in^2$, or more particularly, within a range between about 0.5 tons/$in^2$ and about 3 tons/$in^2$. The shaping process can be the same or different between the first and second mixtures. It is further noted that the first mixture and second mixture are shaped into distinct bodies, such that a first abrasive body is formed from the first mixture, and a second abrasive body is formed from the second mixture.

After shaping the mixtures to form the respective green articles, the process can continue by treating the green articles. Treating can include heat treating the green articles, and particularly sintering of the green articles. In one particular embodiment, treating includes liquid phase sintering to form the bonded abrasive body. Notably, liquid phase sintering includes forming a liquid phase of certain components of the green article, particularly, the bond material, such that at the sintering temperature at least a portion of the bond material is present in liquid phase and free-flowing. Notably, liquid phase sintering is not a process generally used for formation of bonded abrasives utilizing a metal bond material.

In accordance with an embodiment, treating the green article includes heating the green article to a liquid phase sintering temperature of at least 400° C. In other embodiments, the liquid phase sintering temperature can be greater, such as at least 500° C., at least about 650° C., at least about 800° C., or even at least about 900° C. In particular instances, the liquid phase sintering temperature can be within a range between about 400° C. and about 1100° C., such as between about 800° C., and about 1100° C., and more particularly, within a range between about 800° C. and 1050° C. Treating of the respective green articles can be the same or different.

Treating, and particularly sintering, can be conducted for a particular duration. Sintering at the liquid phase sintering temperature can be conducted for a duration of at least about 10 minutes, at least about 20 minutes, at least about 30 minutes, or even at least about 40 minutes. In particular embodiments, the sintering at the liquid phase sintering temperature can last for a duration within a range between about 10 minutes and about 90 minutes, such as between about 10 minutes and 60 minutes, or even between about 15 minutes and about 45 minutes. The duration for the respective green articles can be the same or different.

Treating the green articles can further include conducting a liquid phase sintering process in a particular atmosphere. For example, the atmosphere can be a reduced pressure atmosphere having a pressure of not greater than about $10^{-2}$ Torr. In other embodiments, the reduce pressure atmosphere can have a pressure of not greater than about $10^{-3}$ Torr, not greater than about $10^{-4}$ Torr, such as not greater than about $10^{-5}$ Torr, or even not greater than about $10^{-6}$ Torr. In particular instances, the reduced pressure atmosphere can be within a range between about $10^{-2}$ Torr and about $10^{-6}$ Torr. The pressure during treating the respective green articles can be the same or different.

Additionally, during treating the green articles, and particularly during a liquid phase sintering process, the atmosphere can be a non-oxidizing (i.e., reducing) atmosphere. Suitable gaseous species for forming the reducing atmosphere can include hydrogen, nitrogen, noble gases, carbon monoxide, dissociated ammonia, and a combination thereof. The atmosphere during treating of the respective green articles can be the same or different. For example, in certain embodiments, an inert atmosphere may be used during treating of the first green article, to limit oxidation of the metal and metal alloy components.

After completing the treating process, a first and second bonded abrasive body incorporating abrasive particles within a bond material is formed. In accordance with an embodiment, the first and second body can have particular features.

For example, in accordance with one embodiment, the first or second bonded abrasive bodies can have a significantly greater volume of abrasive particles than the volume of bond material within the body. The first or second bonded abrasive bodies can have a ratio of $V_{AG}/V_{BM}$ of at least about 1.3, wherein $V_{AG}$ represents a volume percent of abrasive particles within the total volume of the bonded abrasive body, and $V_{BM}$ represents the volume percent of bond material within the total volume of the bonded abrasive body. In accordance with another embodiment, the ratio of $V_{AG}/V_{BM}$ can be at least about 1.5, such as at least about 1.7, at least about 2.0, at least about 2.1, at least about 2.2, or even at least about 2.5. In other embodiments, the bonded abrasive body can be formed such that the ratio of $V_{AG}/V_{BM}$ is within a range between about 1.3 and about 9.0, such as between about 1.3 and about 8.0, such as between about 1.5 and about 7.0, such as between about 1.5 and about 6.0, between about 2.0 and about 5.0, between about 2.0 and about 4.0, between about 2.1 and about 3.8, or even between about 2.2 and about 3.5. In particular embodiments, the first body contains the ratio of $V_{AG}/V_{BM}$ and the second body has a ratio of $V_{AG}/V_{BM}$ of less than about 1.3.

In more particular terms, the first or second bonded abrasive bodies can include at least about 30 vol % abrasive particles for the total volume of the bonded abrasive body. In other instances, the content of abrasive particles is greater, such as at least about 45 vol %, at least about 50 vol %, at least about 60 vol %, at least about 70 vol %, or even at least about 75 vol %. In particular embodiments, the bonded abrasive body comprises between about 30 vol % and about 90 vol %, such as between about 45 vol % and about 90 vol %, between about 50 vol % and about 85 vol %, or even between about 60 vol % and about 80 vol % abrasive particles for the total volume of the bonded abrasive body.

The first or second bonded abrasive bodies can include not greater than about 45 vol % bond material for the total volume of the bonded abrasive body. According to certain embodiments, the content of bond material is less, such not greater than about 40 vol %, not greater than about 30 vol %, not greater than about 25 vol %, not greater than about 20 vol %, or even not greater than about 15 vol %. In particular embodiments, the bonded abrasive body comprises between about 5 vol % and about 45 vol %, such as between about 5 vol % and about 40 vol %, between about 5 vol % and about 30 vol %, or even between about 10 vol % and about 30 vol % bond material for the total volume of the bonded abrasive body.

In accordance with another embodiment, the first or second bonded abrasive bodies herein can include a certain amount of porosity. For example, the first or second bonded abrasive bodies can have at least 5 vol % porosity for the total volume of the respective bonded abrasive body. In other embodiments, the bonded abrasive bodies can have at least about 10 vol %, such as at least about 12 vol %, at least about 18 vol %, at least about 20 vol %, at least about 25 vol %, at least about 30 vol %, or even at least about 35 vol % porosity for the total volume of the respective body. Still, in other embodiments, the bonded abrasive bodies can include not greater than about 80 vol % porosity for the total volume of the respective body. In other embodiments, the bonded abrasive bodies can have not greater than about 70 vol %, not greater than about 60 vol %, not greater than about 55 vol %, not greater than about 50 vol %, not greater than about 48 vol %, not greater than about 44 vol %, not greater than about 40 vol %, or even not greater than about 35 vol % porosity for the total volume of the respective body. It will be appreciated that the porosity can fall within a range between any of the minimum and maximum values listed herein.

The bonded abrasive bodies can be formed such that a certain content of the porosity within the bonded abrasive body is interconnected porosity. Interconnected porosity defines a network of interconnected channels (i.e., pores) extending through the volume of the bonded abrasive body. For example, a majority of the porosity of the body can be interconnected porosity. In fact, in particular instances, the bonded abrasive bodies can be formed such that at least 60%, at least about 70%, at least about 80%, at least about 90%, or even at least about 95% of the porosity present within the respective bonded abrasive body is interconnected porosity. In certain instances, essentially all of the porosity present within the respective body is interconnected porosity. Accordingly, the bonded abrasive bodies can be defined by a continuous network of two phases, a solid phase defined by the bond and abrasive particles and a second continuous phase defined by the porosity extending between the solid phase throughout the respective bonded abrasive body.

In accordance with another embodiment, the bonded abrasive bodies can have a particular ratio of particulate material ($V_P$), which includes abrasive particles and fillers, as compared to the bond material ($V_{BM}$) for the total volume of the respective bonded abrasive body. It will be appreciated that the amounts of the particulate material and the bond material are measured in volume percent of the component as part of the total volume of the respective body. For example, the bonded abrasive bodies of embodiments herein can have a ratio ($V_P/V_{BM}$) of at least about 1.5. In other embodiments, the ratio ($V_P/V_{BM}$) can be at least about 1.7, at least about 2.0, at least about 2.2, at least about 2.5, or even at least about 2.8. In particular instances, the ratio ($V_P/V_{BM}$) can be within a range between 1.5 and about 9.0, such as between about 1.5 and 8.0, such as between about 1.5 and about 7.0, between about 1.7 and about 7.0, between about 1.7 and about 6.0, between about 1.7 and about 5.5, or even between about 2.0 and about 5.5. As such, the bonded abrasive bodies can incorporate a higher content of particulate material including fillers and abrasive particles than bond material. In particular embodiments, the first body contains the ratio of $V_{AG}/V_{BM}$ and the second body has a ratio of $V_{AG}/V_{BM}$ of less than about 1.5.

According to one embodiment, the abrasive bodies can include an amount (vol %) of fillers that can be less than, equal to, or even greater than the amount (vol %) of abrasive particles present within the total volume of the respective bonded abrasive body. Certain abrasive articles can utilize not greater than about 75 vol % fillers for the total volume of the respective bonded abrasive body. According to certain embodiments, the content of fillers in the bodies can be not greater than about 50 vol %, not greater than about 40 vol %, not greater than about 30 vol %, not greater than about 20 vol %, or even not greater than about 15 vol %. In particular embodiments, the bonded abrasive bodies comprise between about 1 vol % and about 75 vol %, such as between about 1 vol % and about 50 vol %, between about 1 vol % and about 20 vol %, or even between about 1 vol % and about 15 vol % fillers for the total volume of the respective bonded abrasive body. In one instance, the bonded abrasive bodies can be essentially free of fillers.

The bonded abrasive bodies of embodiments herein can have a particular content of active bond composition. As will be appreciated the active bond composition can be a reaction product formed from a reaction between the active bond composition precursor and certain components of the bonded abrasive body, including for example, abrasive particles, fillers, and bond material. The active bond composition can facilitate chemical bonding between the particulates (e.g., abrasive particles or filler) within the bodies and the bond material, which may facilitate retention of particulates within the bond material.

In particular, the active bond composition can include distinct phases, which can be disposed in distinct regions of the bonded abrasive bodies. Moreover, the active bond composition can have a particular composition depending upon the location of the composition. For example, the active bond composition can include a precipitated phase and an interfacial phase. The precipitated phase can be present within the bond material and can be dispersed as a distinct phase throughout the volume of the bond material. The interfacial phase can be disposed at the interface between the particulate material (i.e., abrasive particles and/or fillers) and the bond material. The interfacial phase can extend around a majority of the surface area of the particulate material of the bodies. While not completely understood, it is theorized that the distinct phases and differences in the composition of the active bond composition are due to the forming processes, particularly liquid phase sintering.

Accordingly, the bond material can be a composite material including a bond phase and a precipitated phase, which are separate phases. The precipitated phase can be made of a composition including at least one element of the active bond composition and at least one element of the bond material. Notably, in the first abrasive body, the precipitated phase can include at least one metal element originally provided in the mixture as the bond material. For example, in the first abrasive body, the precipitated phase can be a metal or metal alloy compound or complex. In particular embodiments, the precipitated phase in the first abrasive body can include a material selected from the group of materials consisting of titanium, vanadium, chromium, zirconium, hafnium, tungsten, and a combination thereof. In more particular instances, the precipitated phase includes titanium, and may consist essentially of titanium and tin.

In the first abrasive body, the bond phase of the bond material can include a transition metal element, and particularly a metal element included in the original bond material used to form the mixture. As such, the bond phase can be formed of a material selected from the group of metals consisting of copper, tin, silver, molybdenum, zinc, tungsten, iron, nickel, antimony, and a combination thereof. In particular instances, the bond phase can include copper, and may be a copper-based compound or complex. In certain embodiments, in the first abrasive body, the bond phase consists essentially of copper.

The interfacial phase can include at least one element of the active bond composition. Moreover, the interfacial phase can include at least one element of the particulate material. As such, the interfacial phase can be a compound or complex formed through a chemical reaction between the active bond composition and the particulate. Certain interfacial phase materials include carbides, oxides, nitrides, borides, oxynitrides, oxyborides, oxycarbides and a combination thereof. The interfacial phase can include a metal, and more particularly, may be a compound incorporating a metal, such as a metal carbide, metal nitride, metal oxide, metal oxynitride, metal oxyboride, or metal oxycarbide. According to one embodiment, the interfacial phase consists essentially of a material from the group of titanium carbide, titanium nitride, titanium boronitride, titanium aluminum oxide, and a combination thereof.

Moreover, the interfacial phase can have an average thickness of at least about 0.1 microns. However, and more particularly, the interfacial phase can have a varying thickness depending upon the size of the particulate material the interfacial phase overlies. For example, with regard to abrasive particles and/or fillers having an average size of less than 10 microns, the interfacial phase can have a thickness within a range between about 1% to 205 of the average size of the particulate. For particulate material having an average size within a range between about 10 microns and about 50 microns, the interfacial phase can have a thickness within a range between about 1% to about 10% of the average size of the particulate. For particulate material having an average size within a range between about 50 microns and about 500 microns, the interfacial phase can have a thickness within a range between about 0.5% to about 10% of the average size of the particulate. For particulate material having an average size of greater than about 500 microns, the interfacial phase can have a thickness within a range between about 0.1% to about 0.5% of the average size of the particulate.

Figure 4:
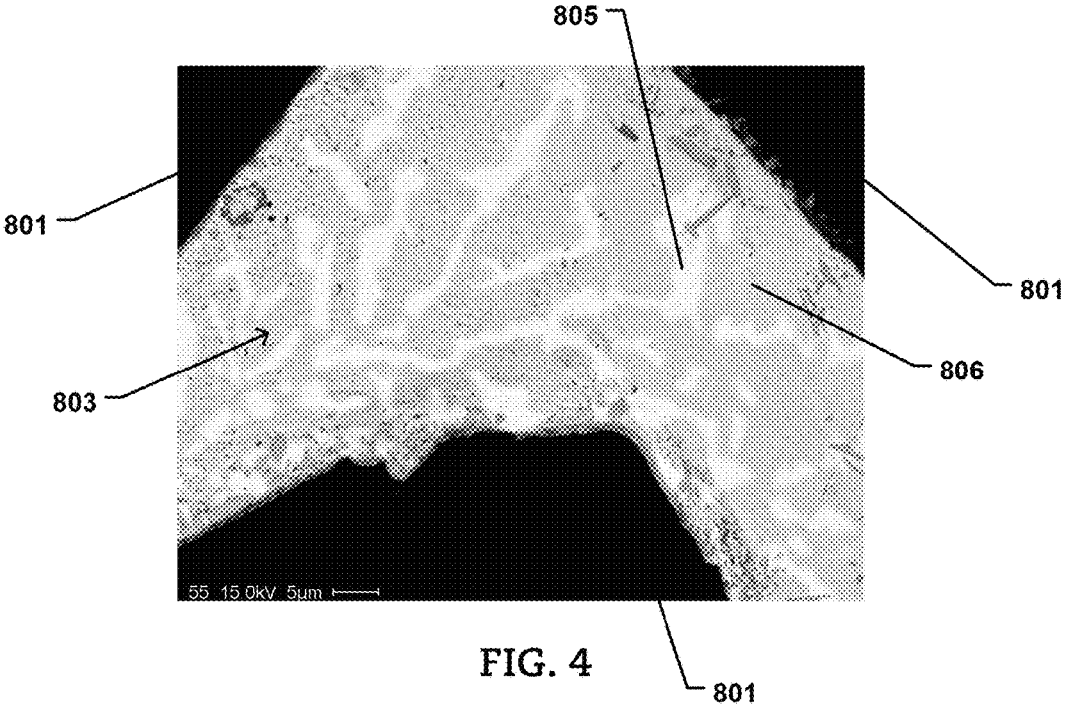
FIGS. 4-7 include magnified images of the microstructure of a bonded abrasive body according to an embodiment.

FIGS. 4-7 include magnified images of the microstructure of a first bonded abrasive body in accordance with an embodiment. FIG. 4 includes a scanning electron microscope image (operated in backscatter mode) of a cross-section of a portion of a bonded abrasive body including abrasive particles 801 and bond material 803 extending between the abrasive particles 801. As illustrated, the bond material 803 includes two distinct phases of material, a precipitated phase 805 represented by a lighter color and extending through the volume of the bond material 803, and a bond phase 806 represented by a darker color and extending through the volume of the bond material 803.

Figure 5:
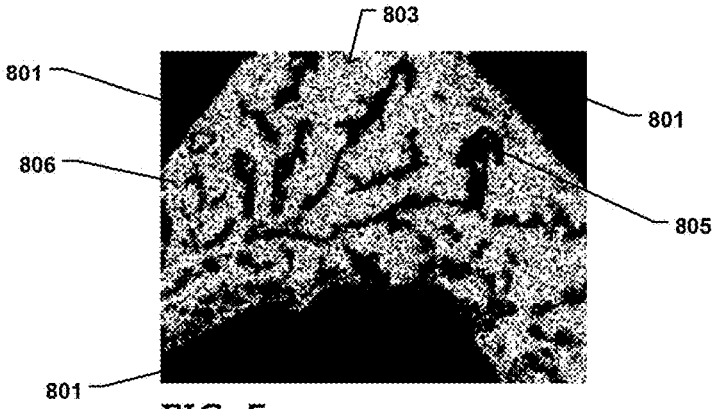

FIGS. 5-11 include magnified images of the same area of the bonded abrasive body of FIG. 4, using microprobe analysis to identify select elements present in certain regions of the body. FIG. 5 includes a microprobe image of the region of FIG. 4 in a mode set to identify regions high in copper, such that the lighter regions indicate regions where copper is present. According to an embodiment, the bond material 803 can include a metal alloy of copper and tin. According to a more particular embodiment, the bond phase 806 of the bond material 803, which is one of at least two distinct phases of the bond material 803, can have a greater amount of copper present than the precipitated phase 805.

Figure 6:
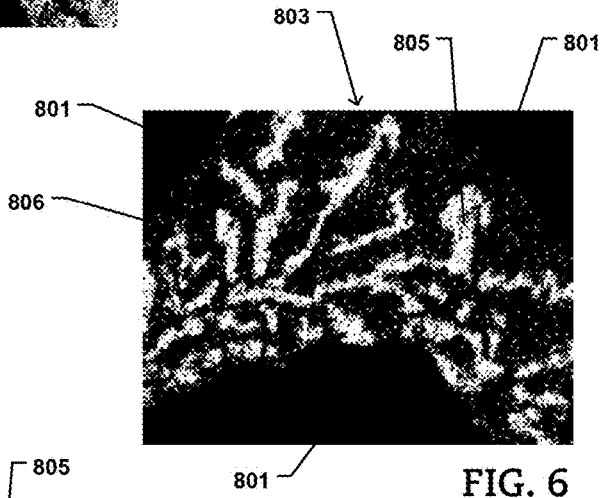

FIG. 6 includes a magnified image of the region of FIGS. 4 and 5, using microprobe analysis to identify select elements present in certain regions of the bonded abrasive body. FIG. 6 uses a microprobe in a mode set to identify regions having tin present, such that the lighter regions indicate regions where tin is more prevalent. As illustrated, the precipitated phase 805 of the bond material 803 has a greater content of tin than the bond phase 806.

Figure 7:
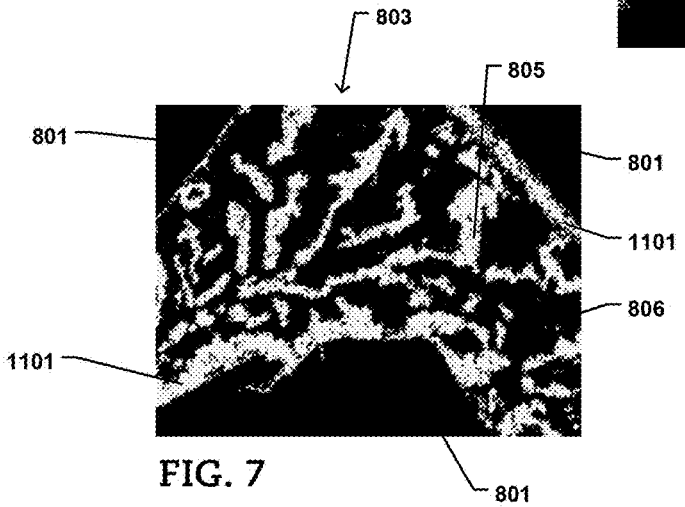

FIG. 7 includes a magnified image of the region of FIG. 4-6, using microprobe analysis. In particular, FIG. 7 uses a microprobe in a mode set to identify regions having titanium present, such that the lighter regions indicate regions where titanium is more prevalent. As illustrated, the precipitated phase 805 of the bond material 803 has a greater content of titanium than the bond phase 806. FIG. 7 also provides evidence of the interfacial phase 1101 at the interface of the abrasive particles 801 and the bond material 803. As evidenced by FIG. 7, the interfacial phase 1101 includes a particularly high content of titanium, indicating that the titanium of the active bond composition precursor may preferentially migrate to the interface of the particulate (i.e., abrasive particles 801) and chemically react with the abrasive particles to form an interracial phase compound as described herein.

FIGS. 4-7 provide evidence of an unexpected phenomenon. While it is not completely understood, the original bond material comprising copper and tin is separated during processing, which is theorized to be due to the liquid phase sintering process. The tin and copper become distinct phases; the precipitated phase 805 and the bond phase 806, respectively. Moreover, the tin preferentially combines with the titanium, present in the active bond composition precursor material to form the precipitated phase 805.

In accordance with an embodiment, the bonded abrasive bodies can include at least about 1 vol % of the active bond composition, which includes all phases of the active bond composition, such as the interfacial phase and the precipitate phase, for the total volume of the bond material. In other instances, the amount of active bond composition within the bond can be greater, such at least about 4 vol %, at least about 6 vol %, at least about 10 vol %, at least about 12 vol %, at least about 14 vol %, at least about 15 vol %, or even at least about 18 vol %. In particular instances, the bond material contains an amount of active bond composition within the range between about 1 vol % and about 40 vol %, such as between about 1 vol % and 30 vol %, between about 1 vol % and about 25 vol %, between about 4 vol % and about 25 vol %, or between about 6 vol % and about 25 vol %. In some instances, the amount of active bond composition is within a range between about 10 vol % and about 30 vol %, between about 10 vol % and about 25 vol %, or even between about 12 vol % and about 20 vol % of the total volume of the bond material.

The bonded abrasive bodies can be formed such that the bond material can have a particular fracture toughness ($K_{1c}$). The toughness of the bond material may be measured via a micro-indentation test or nano-indentation test. Micro-indentation testing measures the fracture toughness through a principle of generating cracks on a polished sample through loading an indentor at a particular location within the material, including for example in the present instance, in the bond material. For example, a suitable micro-indentation test can be conducted according to the methods disclosed in "Indentation of Brittle materials", Microindentation Techniques in Materials Science and Engineering, ASTM STP 889, D. B. Marshall and B. R. Lawn pp 26-46. In accordance with an embodiment, the bonded abrasive bodies can have a bond material having an average fracture toughness ($K_{1c}$) of not greater than about 4.0 MPa $m^{0.5}$. In other embodiments, the average fracture toughness ($K_{1c}$) of the bond material can be not greater about 3.75 MPa $m^{0.5}$, such as not greater about 3.5 MPa $m^{0.5}$, not greater about 3.25 MPa $m^{0.5}$, not greater about 3.0 MPa $m^{0.5}$, not greater about 2.8 MPa $m^{0.5}$, or even not greater about 2.5 MPa $m^{0.5}$. The average fracture toughness of the bond material can be within a range between about 0.6 MPa $m^{0.5}$ about 4.0 MPa $m^{0.5}$, such as within a range between about 0.6 MPa $m^{0.5}$ about 3.5 MPa $m^{0.5}$, or even within a range between about 0.6 MPa $m^{0.5}$ about 3.0 MPa $m^{0.5}$. The bond material in the first bonded abrasive body can have the same or different fracture toughness than the bond material in the second bonded abrasive body. In particular embodiments, the bond material in the first bonded abrasive body can have a lower fracture toughness than the bond material in the second bonded abrasive body. For example, a ratio of the fracture toughness of the bond material in the second bonded abrasive body to the fracture toughness of the bond material in the first bonded abrasive body can be at least about 1:1, at least about 1.5:1, at least about 2:1, at least about 2.5:1, or even at least about 3:1.

The abrasive articles of the embodiments herein may have particular properties. For example, the bonded abrasive bodies can have a modulus of rupture (MOR) of at least about 2000 psi, such as at least about 4000 psi, and more particularly, at least about 6000 psi. The first and second bonded abrasive body can have the same or different MOR. In particular embodiments, the second bonded abrasive body has a higher MOR than the first bonded abrasive body. For example, a ratio of the MOR of the bond material in the second bonded abrasive body to the MOR of the bond material in the first bonded abrasive body can be at least about 1:1, at least about 1.5:1, at least about 2:1, at least about 2.5:1, or even at least about 3:1.

The abrasive articles of the embodiments herein demonstrate particular advantageous properties when used in certain grinding operations. In particular, the bonded abrasive wheels can be used in non-dressed grinding operations, wherein at least one or even all of the bonded abrasive bodies do not require a dressing operation after the body has undergone a truing operation. Traditionally, truing operations are completed to give the abrasive bodies a desired contour and shape. After truing, the abrasive bodies are dressed, typically with an equally hard or harder abrasive element to remove worn particle and expose new abrasive particles. Dressing is a time consuming and necessary process for conventional abrasive articles to ensure proper operation of the abrasive article. The abrasive articles of the embodiments herein have been found to require significantly less dressing during use and have performance parameters that are significantly improved over conventional abrasive articles. In particular embodiments, the bonded abrasive bodies, in particular the first bonded abrasive bodies can be substantially self-dressing, such that some of the bond material can break away during grinding thereby exposing new surfaces of the abrasive particle.

For example, in one embodiment, during a non-dressed grinding operation, the abrasive articles of an embodiment, can have a power variance of not greater than about 40%, wherein power variance is described by the equation [(Po−Pn)/Po]×100%. Po represents the grinding power (Hp or Hp/in) to grind a workpiece with the bonded abrasive body at an initial grinding cycle and Pn represents the grinding power (Hp or Hp/in) to grind the workpiece for a $n^{th}$ grinding cycle, wherein n≥4. Accordingly, the power variance measures the change in grinding power from an initial grinding cycle to a subsequent grinding cycle, wherein at least 4 grinding cycles are undertaken.

In particular, the grinding cycles can be completed in a consecutive manner, which means no truing or dressing operations are conducted on the bonded abrasive article between the grinding cycles. The bonded abrasive articles of the embodiments herein can have a power variance of not greater than about 25% during certain grinding operations. In still other embodiments, the power variance of the bonded abrasive body can be not greater than about 20%, such as not greater than about 15%, or even not greater than about 12%. The power variance of certain abrasive bodies can be within a range between about 1% and about 40%, such as between about 1% and about 20%, or even between about 1% and about 12%.

In further reference to the power variance, it will be noted that the change in grinding power between the initial grinding cycle (Po) and the grinding power used to grind the workpiece at an nth grinding cycle (Pn) can be measured over a number of grinding cycles wherein "n" is greater than or equal to 4. In other instances, "n" can be greater than or equal to 6 (i.e., at least 6 grinding cycles), greater than or equal to 10, or even greater than or equal to 12. Moreover, it will be appreciated that the nth grinding cycle can represent consecutive grinding cycles, wherein dressing is not completed on the abrasive article between the grinding cycles.

In accordance with an embodiment, the abrasive article can be used in grinding operations, wherein the material removal rate (MRR') is at least about 1.0 $in^3$/min/in [10 $mm^3$/sec/mm]. In other embodiments, a grinding operation using an abrasive article of embodiments herein, can be conducted at a material removal rate of at least about 2 $in^3$/min/in [20 $mm^3$/sec/mm], at least about 4.0 $in^3$/min/in [40 $mm^3$/sec/mm], such as at least about 6.0 $in^3$/min/in [60 $mm^3$/sec/mm], at least about 7.0 $in^3$/min/in [70 $mm^3$/sec/mm], or even at least about 8.0 $in^3$/min/in [80 $mm^3$/sec/mm]. Certain grinding operations utilizing the abrasive articles of embodiments herein can be conducted at a material removal rate (MRR') within a range between about 1.0 $in^3$/min/in [10 $mm^3$/sec/mm] and about 20 $in^3$/min/in [200 $mm^3$/sec/mm], within a range between about 5.0 $in^3$/min/in [50 $mm^3$/sec/mm] and about 18 $in^3$/min/in [180 $mm^3$/sec/mm], within a range between about 6.0 $in^3$/min/in [60 $mm^3$/sec/mm] and about 16 $in^3$/min/in [160 $mm^3$/sec/mm]' or even within a range between about 7.0 $in^3$/min/in [70 $mm^3$/sec/mm] and about 14 $in^3$/min/in [140 $mm^3$/sec/mm]. Furthermore, in certain embodiments, the particular MRR' described above can be achieved while concurrently producing a low maximum chip size in the workpiece, and particularly on the edge of the workpiece, as described in more detail below.

Moreover, the abrasive article can be utilized in grinding operations wherein the abrasive article is rotated at particular surface speeds. Surface speed refers to the speed of the wheel at the point of contact with the workpiece. For example, the abrasive article can be rotated at a speed of at least 1500 surface feet per minute (sfpm), such as at least about 1800, such as at least about 2000 sfpm, at least about 2500 sfpm, at least about 5000 sfpm, or even at least 10000 sfpm. In particular instances, the abrasive article can be rotated at a speed within a range between about 2000 sfpm and about 15000 sfpm, such as between about 2000 sfpm and 12000 sfpm.

Figure 1B:
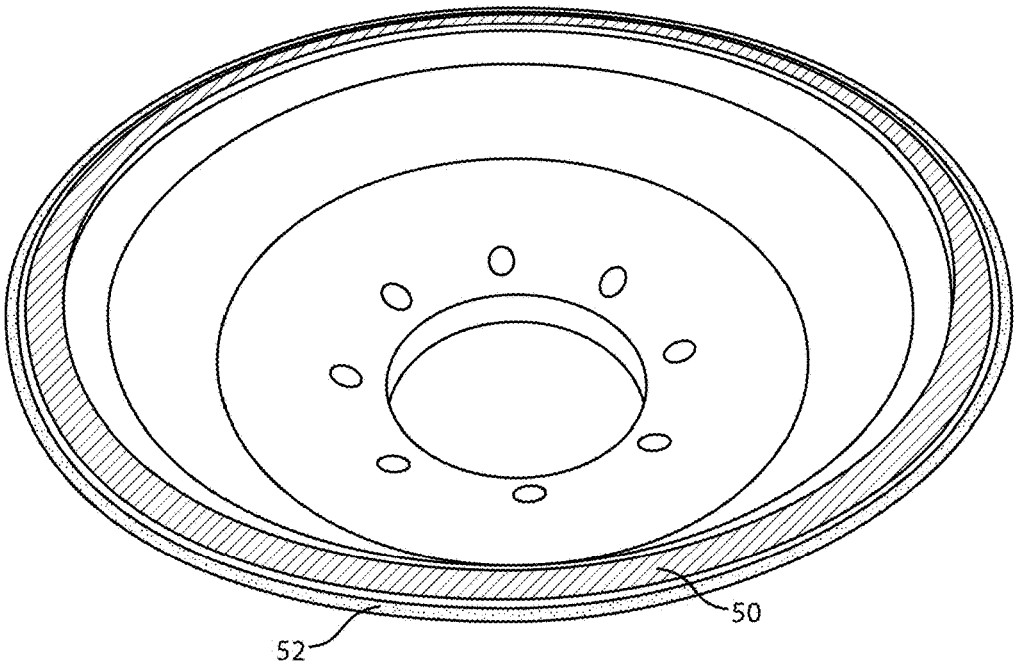
FIG. 1B includes an illustration of an abrasive article according to an embodiment.

In one particular instance, the abrasive articles of the embodiments described herein have been found to be particularly suitable for conducting a periphery grinding operation. For example, periphery grinding operations can be used to form cutting tool inserts to precise specifications. Periphery grinding involves contacting the workpiece at or near the edge of the workpiece. The abrasive article is traditionally in the shape of a wheel or a cup, and the surface of the abrasive bodies to be contacted with the workpiece is flat. Peripheral grinding can grind flat surfaces, tapers or angled surfaces such as chamfers, slots, flat surfaces next to the shoulder, recessed surfaces, profiles, and the like. For example, FIG. 1A illustrates an example of a periphery grinding operation and FIG. 1B illustrates an example of an abrasive article in accordance with embodiments described herein. The cup shaped abrasive article 10 is rotabably mounted to a spindle. The workpiece 30 is secured such that the flat surface 40 of the abrasive bodies 50, 52 contacts the workpiece 30. The grinding wheel can further be configured such that it can move in relation to the workpiece to make contact with the workpiece to produce the desired workpiece dimensions. In particular embodiments, and as illustrated in FIGS. 1A and 1B, the abrasive article can contain a first abrasive body 50 and a second abrasive body 52. The first abrasive body 50 can be nested to, but spaced apart from, the second abrasive body 52. For instance, a gap G can be disposed between the first abrasive body 50 and the second abrasive body 52. The width of the gap G can be a distance sufficient to allow removed material to be transferred from the surface of the workpiece or to account for slight imperfections or noncircularity of the shaped bodies. In particular embodiments, the gap G between the first abrasive body and the second abrasive body can be at least about 1 mm, at least about 3 mm, or even at least about 5 mm. In certain further embodiments, the first body can have a width $W_1$ of at least about 5 mm, at least about 8 mm or even at least about 12 mm. In further embodiments, the second body can have a width $W_2$ of at least about 1 mm, at least about 2 mm or even at least about 3 mm.

As further illustrated in FIG. 1B, the first bonded abrasive body can have a cup shape and can have a diameter that is less than the diameter of the second bonded abrasive body. In other words, the first bonded abrasive body can be disposed closer to the center of the abrasive article than the second bonded abrasive body. In particular embodiments described herein, the abrasive article can be configured such that the first bonded abrasive body contacts the workpiece before the second bonded abrasive body. In further embodiments, the abrasive article can be configured such that the second bonded abrasive body is the last portion of the abrasive article that contacts the workpiece. As described herein, in particular embodiments, the first bonded abrasive body can be configured to have a higher material removal rate than the second bonded abrasive body, and the second bonded abrasive body can be configured to have a lower maximum chip size than the first bonded abrasive body.

Figure 2:
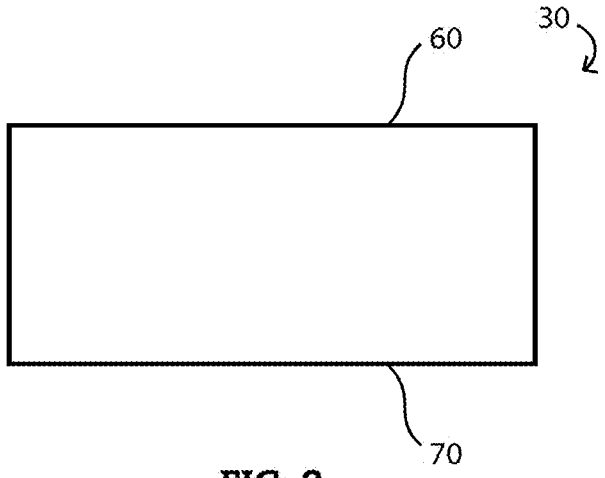
FIG. 2 includes an example of a workpiece before periphery grinding.
Figure 3:
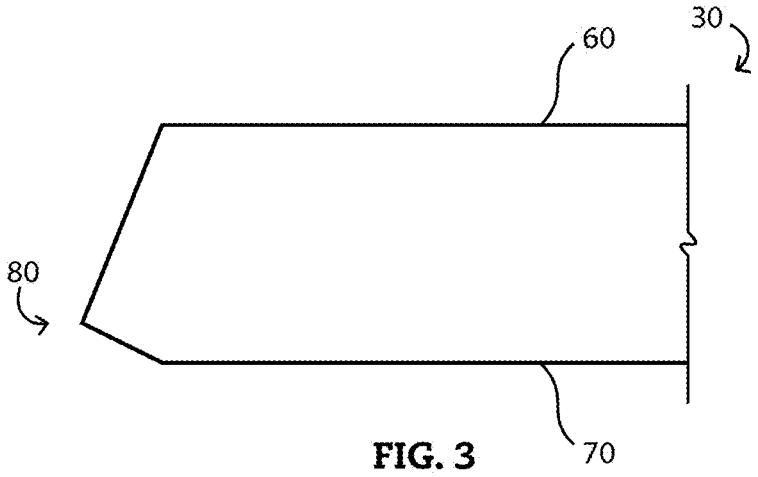
FIG. 3 includes an example of a workpiece after forming a "K" land chamfer on the edge of the workpiece.

In particular embodiments, the periphery grinding operation can include grinding the edge of the workpiece to produce a chamfer having a shape such as a "K" land or "T" land. FIG. 2 illustrates an example of a workpiece 30 before a periphery grinding operation having a first surface 60 and a second surface 70 adjacent to the first surface 60. FIG. 3 illustrates an example of a workpiece 30 after a periphery insert grinding operation produces a "K" land chamfer 80 on the edge of the workpiece 30. As illustrated, the "K" land 80 is disposed between the first surface 60 and the second surface 70. During peripheral grinding of, for example, the "K" land of the workpiece, the "K" land of the workpiece may be more susceptible to chipping than when grinding a major surface of the workpiece. Conventional abrasive articles have been unable to complete the periphery grinding of the workpiece, including grinding to form the "K" lands with acceptable workpiece quality (i.e. chipping quality, such as maximum chip size) and acceptable processing conditions, such as material removal rate and grinding efficiency.

In certain embodiments, in a periphery grinding operation, the abrasive article or the wheel can further be configured to oscillate. Oscillation of the abrasive article or the workpiece can occur during a part of the grinding operation or during all of the grinding operation. In particular embodiments, there can be no oscillation during grinding of a chamfer or angled surfaces such as the "K" lands.

Furthermore, the bonded abrasive bodies of embodiments herein may be utilized in grinding operations, wherein after grinding, in particular periphery grinding, a surface of the workpiece can have an average surface roughness (Ra) that is not greater than about 50 microinches (about 1.25 microns). In other instances, the average surface roughness of the workpiece can be not greater than about 40 microinches (about 1 micron), or even not greater than about 30 microinches (about 0.75 microns). Moreover, in particular embodiments, after grinding edge of the workpiece, such as the "K" land of the workpiece, the "K" land of the workpiece can have an average surface roughness (Ra) that is not greater than about 50 microinches (about 1.25 microns). In other instances, the average surface roughness of the edge of the workpiece can be not greater than about 40 microinches (about 1 micron), or even not greater than about 30 microinches (about 0.75 microns). In further embodiments, the average surface roughness of the "K" land of the workpiece can be within a range in between any of the values above.

In other embodiments, during grinding with bonded abrasive articles of embodiments herein, the average surface roughness variance for at least three consecutive grinding operations can be not greater than about 35%. It should be noted that consecutive grinding operations are operations wherein a truing operation is not conducted between each of the grinding operations. Moreover, between consecutive grinding operations, there is a period where no contact occurs between the abrasive body and the workpiece. The period of time at which no contact occurs can be a time sufficient to change the workpiece. The variance in the average surface roughness can be calculated as a standard deviation of the measured average surface roughness (Ra) of the workpiece at each of the locations on the workpiece, where each separate grinding operation is conducted. In accordance with certain embodiments, the average surface roughness variance for at least three consecutive grinding operations can be not greater than about 25%, not greater than about 20%, not greater than about 15%, not greater than about 10%, or even not greater than about 5%.

In accordance with other embodiments, the bonded abrasive article can have a G-ratio of at least about 1200. The G-ratio is the volume of material removed from the workpiece divided by the volume of material lost from the bonded abrasive bodies through wear. In accordance with another embodiment, the bonded abrasive body can have a G-ratio of at least about 1300, such as at least about 1400, at least about 1500, at least about 1600, at least about 1700, or even at least about 1800. In certain instances, the G-ratio of the bonded abrasive bodies can be within a range between about 1200 and about 2500, such as between about 1200 and about 2300, or even between about 1400 and about 2300. The G-ratio values noted herein can be achieved at the material removal rates noted herein. Moreover, the G-ratio values described can be achieved on a variety of workpiece material types described herein. The first bonded abrasive body can have the same or different G-ratio than the second bonded abrasive body.

The bonded abrasive bodies of the embodiments herein may be suitable for grinding certain workpieces, such as workpieces having a low fracture toughness. For example, workpieces can have an average fracture toughness of less than about 6 $MPa \cdot m^{0.5}$. Examples of materials having an average fracture toughness of less than about 6 $MPa \cdot m^{0.5}$ can include, silicon nitride, alumina, silicon-aluminum oxy nitride (SiAlON). Workpieces exhibiting a fracture toughness of less than about 6 $MPa \cdot m^{0.5}$ are more brittle and susceptible to, for example, chipping during a grinding operation, and particularly in a periphery grinding operation where the "K" land of the workpiece is ground.

When conducting certain grinding operations, for example, a peripheral grinding operation on a workpiece having a fracture toughness of less than about 6 $MPa \cdot m^{0.5}$, after abrading the workpiece with an abrasive article as described herein, the workpiece can exhibit a maximum chip size of less than about 0.0025 inches, less than about 0.002, less than about 0.0015 inches, less than about 0.001 inches, or even less than about 0.0005 inches. The maximum chip size can be measured by observing the workpiece under a microscope and measuring the size of the chips. In particular embodiments, such maximum chip size can be achieved on the edge of the workpiece, such as the "K" land of the workpiece. Notably, such maximum chip size can be achieved while maintaining or achieving other grinding parameters noted herein. For example, such maximum chip size can be achieved with a feed rate, material removal rate, grinding efficiency, or combinations thereof as noted herein.

Moreover, as discussed in more detail below, in consecutive peripheral grinding operations, the variance in the maximum chip size between the workpieces can be calculated as the standard deviation of the maximum chip size. In accordance with certain embodiments, the maximum chip size variance for at least three consecutive grinding operations can be not greater than about 25%, not greater than about 20%, not greater than about 15%, not greater than about 10%, or even not greater than about 5%.

In comparison of the bonded abrasive articles of embodiments described herein to conventional bonded abrasive articles, such as abrasive article described in the examples of US Patent Application Publication No. 2012/0055098 A1, which is incorporated herein by reference in its entirety for all useful purposes, conventional bonded abrasive bodies can not achieve the maximum chip size in particular while maintaining acceptable feed rates and grinding efficiencies. In certain embodiments, the maximum chip size can be at least 5% less than the maximum chip size of a conventional metal-bonded abrasive article. According to another embodiment, the maximum chip size is at least about 8% less, such as at least about 10% less, at least about 15% less, at least about 20% less, at least about 25% less, at least about 30% less, at least about 40% less, or even at least about 50% less as compared to conventional metal-bonded abrasive articles. In particular instances, the improvement in maximum chip size can be within a range between about 5% and about 100%, such as on the order of between about 5% and about 75%, between about 5% and about 60%, or even between about 5% and about 50%.

In conducting certain grinding operations, for example, on workpieces having a low fracture toughness, the abrasive article can be operated at a rate of at least 1800 sfpm. In other instances, the abrasive article can be rotated at a rate of at least 1900 sfpm, at least about 2200 sfpm, or even at least 2350 sfpm. In particular instances, the abrasive article can be rotated at a rate within a range between about 1800 sfpm and about 3100 sfpm, more particularly, within a range between about 1900 sfpm and about 2350 sfpm during grinding operations.

Additionally, the abrasive article of embodiments herein are suitable for certain grinding operations, such as, for example, on workpieces having a low fracture toughness at certain feed rates. For example, the feed rate can be at least about 0.5 inches/min, at least about 1 inch/min, or even at least about 2 inches/min. In other instances, the feed rate can be greater, such as at least about 3 inches/min, at least about 3.5 inches/min, or at least about 4 inches/min. Particular embodiments may utilize the bonded abrasive body in a grinding operation wherein the feed rate is within a range between about 2 inches/min and about 10 inches/min, such as between about 3 inches/min and about 8 inches/min.

In yet another embodiment, the abrasive article can be used in a grinding operation wherein after truing the bonded abrasive bodies with an abrasive truing wheel, the bonded abrasive bodies are capable of peripheral grinding workpieces having a fracture toughness of less than 6 $MPa \cdot m^{0.5}$ for at least 17 consecutive grinding cycles without exceeding the maximum spindle power of the grinding machine. As such, the bonded abrasive bodies demonstrate an improved working lifetime particularly in the context of grinding workpieces having a low fracture toughness. In fact, the abrasive article is capable of conducting at least about 20 consecutive grinding cycles, at least about 25 consecutive grinding cycles, or at least about 30 consecutive grinding cycles before a truing operation is utilized. It will be appreciated that reference to consecutive grinding cycles is reference to grinding cycles conducted in a continuous manner without truing or dressing of the bonded abrasive body between grinding cycles.

In comparison of the bonded abrasive bodies of embodiments herein to conventional bonded abrasive bodies, generally, conventional bonded abrasive articles conduct not greater than about 16 consecutive grinding cycles on workpieces having a low fracture toughness before requiring a truing operation for re-sharpening and resurfacing. As such, the bonded abrasive bodies of embodiments herein demonstrate an improvement of operable grinding time over conventional metal-bonded, bonded abrasives, as measured by the number of consecutive grinding cycles conducted before a truing operation is necessary or the grinding power exceeds the power capabilities of the grinding machine.

Another noteworthy improvement in grinding performance as measured in the industry is parts/dress, which is a measure of the number of parts that can be machined by a particular abrasive article before the abrasive article requires dressing to maintain performance. According to one embodiment, the bonded abrasive bodies of the embodiments herein can have an increase in grinding efficiency on a workpiece, as measured by parts/dress, of at least about 10% compared to a conventional metal-bonded abrasive article. According to another embodiment, the increase in grinding efficiency is at least about 20%, such as at least about 30%, at least about 40%, or even at least about 50% as compared to conventional metal-bonded abrasive articles. Notably, such conventional metal-bonded abrasive articles can include state of the art articles such as G-Force and Spector brand abrasive articles available from Saint-Gobain Corporation. In particular instances, the increase in grinding efficiency as measured by parts/dress can be within a range between about 10% and about 200%, such as on the order of between about 20% and about 200%, between about 50% and about 200%, or even between about 50% and about 150%. In particular embodiments, when grinding a workpiece having a low fracture toughness (e.g. Silicon Nitride), the abrasive article described herein can have a grinding efficiency, as measured by parts/dress of at least about 5, at least about 10, at least about 15, at least about 20, at least about 25, or even at least about 30 parts per dress. It will be appreciated, that such improvements can be achieved on workpieces described herein under the grinding conditions described herein. Notably, such improvements in the grinding efficiency can be achieved while maintaining other grinding parameters noted herein. For example, improvements in grinding efficiency can be achieved while also having a reduced maximum chip size as noted herein.

Additionally, the abrasive article of embodiments herein can have an improvement in grinding performance as measured in the industry by wear rate, which is a measure of the wear an abrasive article experiences during grinding. According to one embodiment, the abrasive article of the embodiments herein can have an improvement in wear rate, such that the abrasive article wears at a rate that is at least 5% less than the wear rate of a conventional metal-bonded abrasive article. According to another embodiment, the wear rate is at least about 8% less, such as at least about 10%, at least about 12%, or even at least about 15% as compared to conventional metal-bonded abrasive articles. In particular instances, the improvement in wear rate can be within a range between about 5% and about 100%, such as on the order of between about 5% and about 75%, between about 5% and about 60%, or even between about 5% and about 50%. It will be appreciated, that such improvements can be achieved on workpieces described herein under the grinding conditions described herein. The wear rate for the first abrasive body can be the same or different for the second abrasive body.

Another noted improvement in grinding performance demonstrated by the abrasive articles of the embodiments herein includes maintaining or even increasing useable grinding rate while improving the workpiece quality as described herein. Grinding rate is the speed at which a workpiece can be shaped without sacrificing the surface finish or exceeding the grinding power of the machine or bonded abrasive article. According to one embodiment, the abrasive article of the embodiments herein can have an improvement in grinding rate, such that the abrasive article can grind at a rate that is at least 5% faster than a conventional metal-bonded abrasive article. In other instances, the grinding rate can be greater, such as at least about 8% less, at least about 10%, at least about 12%, at least about 15%, at least about 20%, or even at least about 25% as compared to conventional metal-bonded abrasive articles. For certain bonded abrasive articles herein, the improvement in grinding rate can be within a range between about 5% and about 100%, such as on the order of between about 5% and about 75%, between about 5% and about 60%, or even between about 5% and about 50%. It will be appreciated, that such improvements can be achieved on workpieces described herein under the grinding conditions described herein.

Notably, such improvements in the grinding rate can be achieved while maintaining other grinding parameters noted herein. For example, improvements in grinding rate can be achieved while also having limited increase in initial grinding power as noted herein, limited variance in the surface finish as noted herein, and limited wear rate as noted herein.

It is to be noted that the performance characteristics as described herein can be achieved according to a periphery insert grinding test operation. As used herein, a periphery insert grinding operation is conducted on a Agathon 400 Combi CNC machine with a silicon nitride workpiece at a rough feed rate of 2 inches/min and a finish feed rate of 1.0 inches/min. The abrasive body is disposed on a cup shaped grinding wheel. The wheel is operated at 8500 SFPM and the depth of the cut is 0.025 inches. All of the grinding characteristics and performance parameters described herein can be achieved when operating under the conditions of the periphery insert grinding test operation.

The bonded abrasive bodies herein demonstrate compositions and grinding properties that are distinct from conventional metal-bonded abrasive articles. The bonded abrasive bodies of the embodiments herein demonstrate improved lifetime of effective grinding, require significantly less dressing than other conventional metal-bonded abrasive bodies, have a lower maximum chip size, and have improved wear properties as compared to state-of-the-art metal-bonded abrasive bodies. Further, embodiments herein are directed to particular aspects of the abrasive particles. It has been noted that the size and/or concentration of the abrasive particles can have a remarkable effect on performance and formability in the context of the bonded abrasive systems of the embodiments herein. For example, in certain instances, if the size of the abrasive particles is too large, the formability of the bonded abrasive system may be undesirable and the performance of the abrasive article is diminished (i.e., high grinding forces, vibration, and poor workpiece surface quality during and after grinding). Still, if the size of the abrasive particles is too small, the performance of the bonded abrasive system may also be limited. Likewise, if the content of abrasive particles in the bonded abrasive body is too great, the system may be difficult to form into a bonded abrasive body. And moreover, if the content of abrasive particles is too low, the performance may be limited.

Furthermore, particular aspects of the forming process for the bonded abrasive bodies herein are thought to be responsible for certain compositions and microstructural features. The bonded abrasive bodies of embodiments herein include a combination of features, which may be attributed to the forming process and facilitate improved grinding performance, including for example, an active bond composition, particular phases of the active bond composition and particular locations of such phases, type and amount of porosity, type and amount and size of abrasive particles, type and amount of fillers, ratios of particulate to bond, ratios of abrasive to bond, and mechanical properties (e.g., fracture toughness) of certain components. In particular embodiments, it has been surprisingly discovered that the abrasive articles as described herein exhibit significantly improved workpiece quality, i.e. reduced chipping number and size, after periphery grinding, and even including a K-land operation. For example, by having the critical average size of the abrasive particles as described herein, brittle workpieces having a fracture toughness of less than 6 MPa m0.5 can exhibit a significant improvement in number of chips or chip size during a periphery insert grinding operation while maintaining and even improving grinding performances such as grinding efficiency and wear rate. It was completely unexpected and surprising that, at least, the type, combination and arrangement of the first and second bonded abrasive bodies, or the abrasive particle size produced these results. For example, it was expected that using smaller abrasive particle size than the examples of US Patent Application Publication No. 20120055098 would be unsuccessful because it would reduce the force per particle exhibited by the abrasive body such that the abrasive body would shatter or the workpiece would be pushed from its holder when enough force is applied to exhibit, for example, an acceptable material removal rate, feed rate, or other processing characteristics. Moreover, with a finer abrasive particle size, there is less of the abrasive particle exposed from the bond material. When there is insufficient grit exposure, an additional frictional component caused by the bond material contacting the workpiece can become substantial. These forces can be especially problematic in a periphery grinding operation.

In the foregoing, reference to specific embodiments and the connections of certain components is illustrative. It will be appreciated that reference to components as being coupled or connected is intended to disclose either direct connection between said components or indirect connection through one or more intervening components to carry out the methods as discussed herein. As such, the above-disclosed subject matter is to be considered illustrative, and not restrictive, and the appended claims are intended to cover all such modifications, enhancements, and other embodiments, which fall within the true scope of the present invention. Thus, to the maximum extent allowed by law, the scope of the present invention is to be determined by the broadest permissible interpretation of the following claims and their equivalents, and shall not be restricted or limited by the foregoing detailed description.

The disclosure will not be used to interpret or limit the scope or meaning of the claims. In addition, in the foregoing description includes various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all features of any of the disclosed embodiments.

Item 1. An abrasive article comprising a first body comprising a first bond material having abrasive particles contained within the first bond material, wherein the first body comprising the first bond material comprises a ratio of $V_{AG(1)}/V_{BM(1)}$ of at least about 1.3; a second body comprising a second bond material having abrasive particles contained within the second bond material, wherein the second body comprising the second bond material comprises a ratio of $V_{AG(2)}/V_{BM(2)}$ of less than about 1.3, and wherein $V_{AG}$ is a volume percent of abrasive particles within a total volume of the first or second body respectively and $V_{BM}$ is a volume percent of the first or second bond material within the total volume of the first or second body respectively.

Item 2. An abrasive article comprising a first body comprising a first bond material having abrasive particles contained within the first bond material, a second body comprising a second bond material having abrasive particles contained within the second bond material, wherein the first bond material and the second bond material are different, and wherein the first body is adjacent to but spaced apart from the second body.

Item 3. An abrasive article comprising a first body comprising a first bond material having abrasive particles contained within the first bond material, a second body comprising a second bond material having abrasive particles contained within the second bond material, wherein the first bond material is different than the second bond material wherein, after a periphery insert grinding test operation on at least an edge of a workpiece, the edge of the workpiece has a maximum chip size of less than about 0.0025 inches.

Item 4. A method of removing material from a workpiece comprising providing a workpiece; and removing material from at least an edge of the workpiece with an abrasive article, wherein the abrasive article comprises a first body comprising a first bond material having abrasive particles contained within the first bond material, wherein the first body comprising the first bond material comprises a ratio of $V_{AG(1)}/V_{BM(1)}$ of at least about 1.3, a second body comprising a second bond material having abrasive particles contained within the second bond material, wherein the second body comprising the second bond material comprises a ratio of $V_{AG(2)}/V_{BM(2)}$ of less than about 1.3, and wherein $V_{AG}$ is a volume percent of abrasive particles within a total volume of the first or second body respectively and $V_{BM}$ is a volume percent of the first or second bond material within the total volume of the first or second body respectively.

Item 5. A method of removing material from a plurality of workpieces comprising providing a plurality of workpieces; and performing consecutive periphery grinding operations on at least 5 workpieces with an abrasive article comprising a first body and a second body spaced apart from the first body, wherein the consecutive periphery grinding operations are performed without dressing the abrasive article in between the consecutive periphery grinding operations; wherein, after performing the periphery grinding operations, the plurality of workpieces have an average maximum chip size on the edge of the workpiece of less than about 0.0025 inches.

Item 6. The abrasive article or method of any one of the preceding claims, wherein the first or second bond material comprises at least 1 vol %, at least 5 vol %, at least 14 vol %, at least 15 vol %, or even at least 18 vol % of an active bond composition of the total volume of the bond material.

Item 7. The abrasive article or method of any one of the preceding claims, wherein the first bond material comprises an active bond composition comprising a compound including a metal or metal alloy.

Item 8. The abrasive article or method of any one of the preceding claims, wherein the first bond material comprises an active bond composition comprising a metal element selected from the group of metal elements consisting of titanium, vanadium, chromium, zirconium, hafnium, tungsten, and a combination thereof.

Item 9. The abrasive article or method of any one of the preceding claims, wherein the abrasive particle in the first or second body consists essentially of a superabrasive, in particular CBN or diamond or a combination thereof.

Item 10. The abrasive article or method of any one of the preceding claims, wherein the first or second bond material comprises an active bond composition comprising a compound selected from the group consisting of carbides, nitrides, oxides, and a combination thereof.

Item 11. The abrasive article or method of any one of the preceding claims, wherein the first bond material comprises an active bond composition consisting essentially of titanium carbide.

Item 12. The abrasive article or method of any one of the preceding claims, wherein the first or second bond material comprises an active bond composition disposed at an interface of the abrasive particles and the respective bond material.

Item 13. The abrasive article or method of any one of the preceding claims, wherein a portion of the active bond composition within the first or second bond material at least partially surrounds the abrasive particles at an interface between the abrasive particles and the respective bond material.

Item 14. The abrasive article or method of any one of the preceding claims, wherein the first bond material comprises bond posts extending between abrasive particles, and wherein the active bond composition is distributed within the bond posts.

Item 15. The abrasive article or method of any one of the preceding claims, wherein the abrasive particles in the first or second body comprise a superabrasive material.

Item 16. The abrasive article of claim 15, wherein the abrasive particles consist essentially of diamond.

Item 17. The abrasive article or method of any one of the preceding claims, wherein the abrasive particles have an average particle size of not greater than about 44 microns, not greater than about 40 microns, not greater than about 38 microns, not greater than about 36 microns, not greater than about 34 microns, not greater than about 32 microns, not greater than about 30 microns, not greater than about 28 microns, not greater than about 26 microns, not greater than about 24 microns, not greater than about 22 microns, or even not greater than about 20 microns.

Item 18. The abrasive article or method of any one of the preceding claims, wherein the abrasive particles have an average particle size of at least about 1 micron, at least about 2 microns, at least about 4 microns, at least about 6 microns, at least about 8 microns, at least about 10 microns, at least about 12 microns, at least about 14 microns, at least about 16 microns, at least about 18 microns, or even at least about 20 microns.

Item 19. The abrasive article or method of any one of the preceding claims, wherein the abrasive particles have an aspect ratio of not greater than about 2:1, or even not greater than about 1.5:1, wherein aspect ratio is defined as a ratio of the dimensions length:width.

Item 20. The abrasive article or method of any one of the preceding claims, wherein the abrasive particles are substantially equi-axed.

Item 21. The abrasive article or method of any one of the preceding claims, wherein the first bond material comprises at least one transition metal element.

Item 22. The abrasive article or method of any one of the preceding claims, wherein the first bond material comprises a metal selected from the group of metals consisting of copper, tin, silver, molybdenum, zinc, tungsten, iron, nickel, antimony, and a combination thereof.

Item 23. The abrasive article or method of any one of the preceding claims, wherein the first bond material comprises a metal alloy including copper and tin.

Item 24. The abrasive article or method of any one of the preceding claims, wherein the ratio of $V_{AG}/V_{BM}$ of the first body is at least about 1.5, at least about 1.7, at least about 2.0, at least about 2.1, or even at least about 2.2.

Item 25. The abrasive article or method of any one of the preceding claims, wherein the ratio of $V_{AG}/V_{BM}$ in the first body is within a range between about 1.3 and about 9.0, between about 1.3 and about 8.0, between about 1.5 and about 7.0, between about 1.5 and about 6.0, or even between about 2.0 and about 5.0.

Item 26. The abrasive article or method of any one of the preceding claims, wherein the first or second bond material comprises an average fracture toughness ($K_{1c}$) of not greater about 4.0 MPa $m^{0.5}$, not greater than about 3.75 MPa $m^{0.5}$, not greater about 3.5 MPa $m^{0.5}$ not greater about 3.25 MPa $m^{0.5}$, not greater about 3.0 MPa $m^{0.5}$, not greater about 2.8 MPa $m^{0.5}$, or even not greater about 2.5 MPa $m^{0.5}$ Item 27. The abrasive article or method of any one of the preceding claims, wherein the first and second bond material comprises an average fracture toughness ($K_{1c}$) within a range between about 0.6 MPa $m^{0.5}$ and about 4.0 MPa $m^{0.5}$, between about 0.6 MPa $m^{0.5}$ and about 3.5 MPa $m^{0.5}$, or even between about 0.6 MPa $m^{0.5}$ and about 3.0 MPa $m^{0.5}$.28. The abrasive article or method of any one of the preceding claims, wherein the first or second body comprises at least about 5 vol % porosity, wherein a majority of the porosity is interconnected porosity defining a network of interconnected pores extending through the volume of the body.

Item 29. The abrasive article or method of any one of the preceding claims, wherein at least some of the abrasive particles comprise a coating.

Item 30. The abrasive article or method of claim 29, wherein the abrasive particles in the first body comprise a coating comprising a metal or metal alloy, in particular nickel.

Item 31. The abrasive article or method of claim 30, wherein the coating includes an electroplated metal layer applied to the abrasive particles.

Item 32. The abrasive article or method of any one of the preceding claims, wherein the first or second body comprise fillers, and wherein the fillers include particulate materials incorporated into the body that substantially maintain their original shape and size.

Item 33. The abrasive article or method of any one of the preceding claims, wherein the first or second body comprise fillers, and wherein the fillers comprise a material selected from the group of materials consisting of oxides, carbides, borides, silicides, nitrides, oxynitrides, oxycarbides, silicates, graphite, silicon, inter-metallics, ceramics, hollow-ceramics, fused silica, glass, glass-ceramics, hollow glass spheres, and a combination thereof.

Item 34. The abrasive article or method of any one of the preceding claims, wherein the first or second body comprise fillers, and wherein the fillers comprise a fracture toughness ($K_{1c}$) of not greater than about 10 MPa $m^{0.5}$, not greater than about 9 MPa $m^{0.5}$, not greater than about 8 MPa $m^{0.5}$, or even not greater than about 7 MPa $m^{0.5}$.

Item 35. The abrasive article or method of any one of the preceding claims, wherein the first or second body comprise fillers, and wherein the fillers comprise not greater than about 30 vol % of the total volume of the respective body.

Item 36. The abrasive article or method of any one of the preceding claims, wherein the first or second body comprise fillers, and wherein the fillers are present in an amount less than an amount of the abrasive particles as measured by volume percent of the total volume of the respective body.

Item 37. The abrasive article or method of any one of the preceding claims, wherein the active bond composition is present in an amount within a range between about 1 vol % and about 40 vol %, about 10 vol % and about 30 vol %, 10 vol % and about 25 vol %, or even 12 vol % and about 20 vol % of the total volume of the bond material.

Item 38. The abrasive article or method of any one of the preceding claims, wherein the first or second body comprises at least about 5 vol %, at least about 10 vol %, at least about 20 vol %, at least about 25 vol % at least about 30 vol %, or even at least about 35 vol % porosity of the total volume of the body.

Item 39. The abrasive article or method of any one of the preceding claims, wherein the first or second body comprises not greater than about 80 vol %, not greater than about 60 vol %, not greater than about 50 vol % porosity of the total volume of the body, not greater than about 40 vol % or even not greater than about 35 vol % porosity of the total volume of the body.

Item 40. The abrasive article or method of any one of the preceding claims, wherein the first body comprises a ratio of $V_P/V_{BM}$ of at least about 1.5, at least about 1.7, at least about 2.0, or even at least about 2.2, wherein $V_P$ is a volume percent of particulate material including abrasive grains and fillers within a total volume of the body and $V_{BM}$ is a volume percent of bond material within the total volume of the body.

Item 41. The abrasive article or method of any one of the preceding claims, wherein the ratio of $V_P/V_{BM}$ in the first body is within a range between about 1.5 and about 9.0 or even within a range between about 1.5 and about 8.0.

Item 42. The abrasive article or method of any one of the preceding claims, wherein the maximum chip size after material is removed on the edge of a workpiece is less than about 0.0025 inches, less than about 0.002, less than about 0.0015 inches, less than about 0.001 inches, or even less than about 0.0005 inches.

Item 43. The abrasive article or method of any one of the preceding claims, wherein the abrasive article exhibits a material removal rate of at least about 1.0 $in^3$/min/in [10 $mm^3$/sec/mm], at least about 2 $in^3$/min/in [20 $mm^3$/sec/mm], at least about 4.0 $in^3$/min/in [40 $mm^3$/sec/mm], such as at least about 6.0 $in^3$/min/in [60 $mm^3$/sec/mm], at least about 7.0 $in^3$/min/in [70 $mm^3$/sec/mm], or even at least about 8.0 $in^3$/min/in [80 $mm^3$/sec/mm] on a silicon nitride workpiece.

Item 44. The abrasive article or method of any one of the preceding claims, wherein the abrasive article exhibits a feed rate of at least about 0.5 inches/min, at least about 1 inch/min, or even at least about 2 inches/min with a silicon nitride workpiece.

Item 45. The abrasive article or method of any one of the preceding claims, wherein the first bond material comprises a metal, and wherein the second bond material comprises a resin.

Item 46. The abrasive article or method of any one of the preceding claims, wherein the first body is spaced apart from the second body by a length of at least about 1 mm, at least about 3 mm, or even at least about 5 mm.

Item 47. The abrasive article or method of any one of the preceding claims, wherein the first body has a width of at least about 5 mm, at least about 8 mm or even at least about 12 mm.

Item 48. The abrasive article or method of any one of the preceding claims, wherein the second body has a width of at least about 1 mm, at least about 2 mm or even at least about 3 mm.

Item 49. The abrasive article or method of any one of the preceding claims, wherein the first body has a greater width than the second body.

Item 50. The abrasive article or method of any one of the preceding claims, wherein the first body has a smaller diameter than the second body.

Item 51. The abrasive article or method of any one of the preceding claims, wherein the first bond material has an average fracture toughness which is greater than an average fracture toughness of the second bond material.

Item 52. The abrasive article or method of any one of the preceding claims, wherein the workpiece comprises a fracture toughness of less than about 6 MPa·$m^{0.5}$.

Item 53. The abrasive article or method of any one of the preceding claims, wherein the second bond material comprises a phenol formaldehyde, novalacs, melamine, acrylic, polyimide, polyamide, aramid, epoxy, polyester, polyurethane, acetate, or a combination thereof.

What is claimed is:

1. An abrasive article comprising:

a first body comprising a first bond material having abrasive particles contained within the first bond material, a second body comprising a second bond material having abrasive particles contained within the second bond material, wherein the first bond material and the second bond material are different, wherein the first bond material comprises an active bond composition comprising a compound including a metal or metal alloy, and wherein the first body is adjacent to but spaced apart from the second body.

2. The abrasive article of claim 1, wherein the first body is spaced apart from the second body by a length of at least about 1 mm.

3. The abrasive article of claim 1, wherein the first body has a width of at least about 5 mm.

4. The abrasive article of claim 3, wherein the second body has a width of at least about 1 mm.

5. The abrasive article of claim 1, wherein the first body has a greater width than the second body.

6. The abrasive article of claim 1, wherein the first body has a smaller diameter than the second body.

7. The abrasive article of claim 1, wherein the first bond material has an average fracture toughness which is greater than an average fracture toughness of the second bond material.

8. The abrasive article of claim 1, wherein the first body comprises a ratio of $V_P/V_{BM}$ of at least about 1.5, wherein $V_P$ is a volume percent of particulate material including abrasive grains and fillers within a total volume of the body and $V_{BM}$ is a volume percent of bond material within the total volume of the body.

9. The abrasive article of claim 1, wherein the first bond material comprises at least 1 vol % of an active bond composition of the total volume of the bond material.

10. The abrasive article of claim 1, wherein the first bond material comprises an active bond composition comprising a metal element selected from the group of metal elements consisting of titanium, vanadium, chromium, zirconium, hafnium, tungsten, and a combination thereof.

11. The abrasive article of claim 1, wherein the abrasive particle in the first or second body consists essentially of a superabrasive.

12. The abrasive article of claim 1, wherein the first or second bond material comprises an active bond composition comprising a compound selected from the group consisting of carbides, nitrides, oxides, and a combination thereof.

13. The abrasive article of claim 1, wherein the first or second bond material comprises an active bond composition disposed at an interface of the abrasive particles and the respective bond material.

14. The abrasive article of claim 13, wherein a portion of the active bond composition within the first or second bond material at least partially surrounds the abrasive particles at an interface between the abrasive particles and the respective bond material.

15. The abrasive article of claim 13, wherein the first bond material comprises bond posts extending between abrasive particles, and wherein the active bond composition is distributed within the bond posts.

16. The abrasive article of claim 1, wherein the abrasive particles consist essentially of diamond.

17. The abrasive article of claim 1, wherein the abrasive particles have an average particle size of not greater than about 44 microns.

18. The abrasive article of claim 1, wherein the abrasive particles have an average particle size of at least about 1 micron.

* * * * *